US007464578B2

(12) United States Patent
Ayer et al.

(10) Patent No.: US 7,464,578 B2
(45) Date of Patent: Dec. 16, 2008

(54) HAND-HELD, PORTABLE, BATTERY-POWERED HYDRAULIC TOOL

(75) Inventors: John W. Ayer, Milford, NH (US); Dean E. Geibel, New Cumberland, PA (US); Alan D. Beck, Bow, NH (US); Armand T. Montminy, Manchester, NH (US); John D. Lefavour, Litchfield, NH (US); Robert M. Poirier, Bedford, NH (US); Christopher G. Chadbourne, Nashua, NH (US); Samuel L. Millen, Somerville, MA (US)

(73) Assignee: FCI Americas Technology, Inc., Carson City, NV (US)

( * ) Notice: Subject to any disclaimer, the term of this patent is extended or adjusted under 35 U.S.C. 154(b) by 166 days.

(21) Appl. No.: 11/398,986

(22) Filed: Apr. 5, 2006

(65) Prior Publication Data

US 2006/0272381 A1 Dec. 7, 2006

Related U.S. Application Data

(60) Provisional application No. 60/687,394, filed on Jun. 3, 2005.

(51) Int. Cl.
*B21D 9/18* (2006.01)
*B21D 7/06* (2006.01)

(52) U.S. Cl. ..... 72/453.15; 72/453.16; 72/407; 60/477

(58) Field of Classification Search ..... 72/453.15, 72/453.16, 453.17, 409.14, 407; 60/477, 60/479

See application file for complete search history.

(56) References Cited

U.S. PATENT DOCUMENTS

| | | | |
|---|---|---|---|
| 643,961 | A | 2/1900 | Hanten et al. |
| 723,356 | A | 3/1903 | Bayrer |
| 788,575 | A | 5/1905 | Bernard |
| 878,493 | A | 2/1908 | Barnes |
| 951,076 | A | 3/1910 | Jones |

(Continued)

FOREIGN PATENT DOCUMENTS

| | | | |
|---|---|---|---|
| CA | 2270060 | A1 | 10/2000 |

(Continued)

OTHER PUBLICATIONS

1. Parts List, Fairmont EK425 Battery Powered Crimping Tool, 4 pages, 2004.

(Continued)

*Primary Examiner*—David B Jones
(74) *Attorney, Agent, or Firm*—Harrington & Smith, PC

(57) ABSTRACT

A hand-held, battery-powered, hydraulically-actuated tool including a frame forming a tool longitudinal axis; a battery offset from the tool longitudinal axis; and located along the tool longitudinal axis a motor connected to the battery; a hydraulic fluid pump connected to the motor, such as by a transmission; a ram movably connected to the frame and adapted to be moved relative to the frame by hydraulic fluid pumped by the hydraulic fluid pump; and a working head adapted to be actuated by the ram. The tool includes a main section situated in an in-line configuration along the tool longitudinal axis. A center longitudinal axis of the battery is offset from the tool longitudinal axis.

29 Claims, 17 Drawing Sheets

U.S. PATENT DOCUMENTS

| | | | | |
|---|---|---|---|---|
| 1,619,137 | A | | 3/1927 | Knott 72/409.15 |
| 1,974,913 | A | | 9/1934 | Childress 81/9.1 |
| 2,355,520 | A | | 8/1944 | Fischer et al. 78/48 |
| 2,367,552 | A | | 1/1945 | Ahrndt 294/87 |
| 2,369,180 | A | | 2/1945 | Rosenthal 81/15 |
| 2,369,344 | A | | 2/1945 | Ehmann 59/86 |
| 2,396,562 | A | | 3/1946 | Forss 140/55 |
| 2,595,989 | A | | 5/1952 | Smeltz 43/53.5 |
| 2,600,860 | A | | 6/1952 | Dupre 81/15 |
| 2,766,631 | A | | 10/1956 | Van Sittert 74/110 |
| 2,897,703 | A | | 8/1959 | Fischer et al. 81/15 |
| 2,942,507 | A | | 6/1960 | Fischer et al. 81/15 |
| 2,979,032 | A | | 4/1961 | Engquist et al. 121/3 |
| 3,026,646 | A | | 3/1962 | Weaver 43/43.12 |
| 3,037,208 | A | | 6/1962 | Haberstemp 1/220 |
| 3,044,074 | A | | 7/1962 | Tebb et al. 1/342 |
| 3,178,816 | A | | 4/1965 | Schmid 30/228 |
| 3,203,221 | A | | 8/1965 | Conner 72/410 |
| 3,372,479 | A | | 3/1968 | Fischer 30/180 |
| 3,427,837 | A | | 2/1969 | Faulconer 72/15 |
| 3,453,822 | A | | 7/1969 | Crook, Jr. 59/85 |
| 3,481,373 | A | | 12/1969 | Blagojevich 140/113 |
| 3,626,445 | A | | 12/1971 | Penix 60/52 |
| 3,680,212 | A | | 8/1972 | Rozmus 30/266 |
| 3,693,254 | A | | 9/1972 | Salonen 30/228 |
| 3,772,907 | A | | 11/1973 | Rider 72/412 |
| 3,830,089 | A | | 8/1974 | Boyd et al. 72/407 |
| 3,972,218 | A | | 8/1976 | Pawloski 72/407 |
| 3,994,127 | A | | 11/1976 | Gower 59/85 |
| 4,109,504 | A | | 8/1978 | Rommel 72/407 |
| 4,179,878 | A | | 12/1979 | Albertini 59/85 |
| 4,226,110 | A | | 10/1980 | Suganuma 72/416 |
| 4,257,135 | A | | 3/1981 | Moebius 7/125 |
| 4,260,323 | A | | 4/1981 | Muntjanoff 414/731 |
| 4,336,703 | A | | 6/1982 | Thomas 72/104 |
| 4,359,821 | A | | 11/1982 | Pellenc 30/228 |
| 4,366,673 | A | | 1/1983 | Lapp 60/477 |
| 4,392,263 | A | | 7/1983 | Amoroso 7/100 |
| 4,418,562 | A | | 12/1983 | Sakai et al. 72/444 |
| 4,426,869 | A | | 1/1984 | Farmer et al. 72/104 |
| 4,617,816 | A | | 10/1986 | Brinkman 72/104 |
| 4,760,644 | A | | 8/1988 | Yirmiyahu et al. 30/180 |
| 4,791,726 | A | | 12/1988 | Ailey, Jr. 30/228 |
| 4,796,461 | A | | 1/1989 | Mead 72/453.16 |
| 4,869,465 | A | | 9/1989 | Yirmiyahu et al. 254/93 R |
| 4,890,474 | A | | 1/1990 | Agostini et al. 72/416 |
| 4,912,349 | A | | 3/1990 | Chang 310/50 |
| 4,956,992 | A | * | 9/1990 | Undin 72/451 |
| 5,002,135 | A | | 3/1991 | Pellenc 173/170 |
| 5,040,278 | A | | 8/1991 | Eckold et al. 29/243.53 |
| 5,105,543 | A | | 4/1992 | Maarschalk et al. 30/228 |
| 5,138,864 | A | | 8/1992 | Tarpill 72/410 |
| 5,152,162 | A | | 10/1992 | Ferraro et al. 72/20 |
| 5,243,761 | A | | 9/1993 | Sullivan et al. 30/134 |
| 5,253,554 | A | | 10/1993 | Riera et al. 81/9.3 |
| 5,309,751 | A | | 5/1994 | Ryan 72/450 |
| 5,335,530 | A | | 8/1994 | Homm 72/402 |
| 5,381,686 | A | | 1/1995 | Thorup 72/453.06 |
| 5,442,992 | A | | 8/1995 | Sanner et al. 91/428 |
| 5,487,297 | A | | 1/1996 | Ryan et al. 72/450 |
| 5,509,194 | A | | 4/1996 | Hornung et al. 29/751 |
| 5,553,478 | A | * | 9/1996 | Di Troia 72/453.15 |
| D374,805 | S | | 10/1996 | Moffatt et al. D8/107 |
| 5,566,454 | A | | 10/1996 | Eisenbraun 30/228 |
| 5,566,770 | A | | 10/1996 | Bowser 173/218 |
| 5,611,228 | A | | 3/1997 | Dummermuth 72/21.2 |
| 5,642,566 | A | | 7/1997 | Hirabayashi 30/228 |
| D383,046 | S | | 9/1997 | Moffatt et al. D8/69 |
| 5,711,078 | A | | 1/1998 | Patton et al. 30/228 |
| 5,727,417 | A | | 3/1998 | Moffatt et al. 72/453.03 |
| 5,730,022 | A | | 3/1998 | Hansson et al. 72/453.16 |
| 5,778,755 | A | | 7/1998 | Boese 91/399 |
| 5,806,362 | A | | 9/1998 | Dubugnon 72/453.04 |
| 5,839,316 | A | | 11/1998 | Kolivoski et al. 72/453.16 |
| D405,233 | S | | 2/1999 | Hirabayashi et al. D8/61 |
| 5,875,554 | A | | 3/1999 | Vogelsanger 30/228 |
| D408,242 | S | | 4/1999 | Yamamoto D8/61 |
| 5,934,136 | A | | 8/1999 | Bracher et al. 72/397 |
| 5,953,822 | A | | 9/1999 | Vogelsanger 30/228 |
| 6,000,680 | A | | 12/1999 | Kimura et al. 254/93 R |
| 6,044,564 | A | | 4/2000 | Jeltsch 30/228 |
| 6,044,686 | A | | 4/2000 | Dischler 72/402 |
| 6,075,341 | A | * | 6/2000 | White et al. 320/114 |
| 6,092,290 | A | | 7/2000 | Vogelsanger 30/228 |
| 6,138,346 | A | | 10/2000 | Shutts et al. 29/758 |
| 6,145,360 | A | * | 11/2000 | Honsel et al. 72/453.15 |
| 6,164,106 | A | | 12/2000 | Nghiem et al. 72/20.1 |
| 6,202,290 | B1 | | 3/2001 | Kewitz et al. 29/701 |
| 6,220,074 | B1 | | 4/2001 | Montminy et al. 72/454 |
| 6,240,626 | B1 | | 6/2001 | Ngheim 29/701 |
| 6,364,033 | B1 | | 4/2002 | Hung et al. 173/217 |
| 6,415,641 | B1 | | 7/2002 | Wagner 72/393 |
| 6,446,482 | B1 | | 9/2002 | Heskey et al. 72/453.16 |
| 6,453,719 | B1 | | 9/2002 | Heskey et al. 72/453.16 |
| 6,457,338 | B1 | | 10/2002 | Frenken 72/20.1 |
| 6,467,556 | B2 | | 10/2002 | Alsruhe 173/217 |
| 6,532,790 | B2 | | 3/2003 | Frenken 72/456 |
| 6,619,101 | B1 | | 9/2003 | Faucher et al. 72/456 |
| 6,666,064 | B2 | | 12/2003 | LeFavour et al. 72/453.15 |
| 6,668,613 | B2 | | 12/2003 | Lefavour et al. 72/453.02 |
| 6,722,618 | B1 | | 4/2004 | Wu 248/166 |
| 6,769,173 | B2 | | 8/2004 | Chadbourne 29/761 |
| 6,769,283 | B2 | | 8/2004 | Suresh 72/416 |
| 6,792,789 | B1 | | 9/2004 | Faucher 72/456 |
| 6,986,274 | B2 | | 1/2006 | Lefavour et al. 72/453.16 |
| 7,036,806 | B2 | | 5/2006 | Amherd et al. 269/6 |
| 7,055,622 | B2 | | 6/2006 | Bone 173/217 |
| 7,111,488 | B2 | | 9/2006 | Lefavour et al. 72/453.16 |
| 7,155,955 | B2 | | 1/2007 | Bowles et al. 72/453.16 |
| 7,216,523 | B2 | | 5/2007 | Frenken 72/416 |
| 7,219,526 | B2 | | 5/2007 | Herod 72/453.07 |
| 7,254,982 | B2 | * | 8/2007 | Frenken 72/453.15 |
| 2002/0007658 | A1 | | 1/2002 | Amherd 72/453.16 |
| 2003/0188566 | A1 | | 10/2003 | Lefavour et al. 72/453.16 |
| 2006/0272381 | A1 | | 12/2006 | Ayer et al. 72/453.16 |
| 2006/0277969 | A1 | | 12/2006 | Gregg 72/480 |

FOREIGN PATENT DOCUMENTS

| | | | |
|---|---|---|---|
| DE | 10124267 | | 11/2002 |
| EP | 0389716 | A1 | 10/1990 |
| EP | 0676835 | A2 | 10/1995 |
| EP | 0 860 245 | A2 | 8/1998 |
| EP | 0941813 | A1 | 9/1999 |
| EP | 1337016 | A2 | 8/2003 |
| EP | 1555077 | | 1/2005 |
| JP | 06-145874 | | 1/1996 |
| WO | WO-03/084719 | A2 | 10/2003 |

OTHER PUBLICATIONS

2. FCI 2005 Master Catalog, pp. 581-590.

Patent Abstract of Japan, Yasufusa, T. et al., "Oil Tank Structure For Charging Type Hydraulic Tool", Publication No. 08-011065, Application No. 06-145874.

* cited by examiner

HAND-HELD, PORTABLE, BATTERY-POWERED HYDRAULIC TOOL

CROSS-REFERENCE TO RELATED APPLICATION

This patent application claims priority under 35 U.S.C. §119(e) on Provisional Patent Application No. 60/687,394, filed Jun. 3, 2005, which is hereby incorporated by reference in its entirety.

BACKGROUND OF THE INVENTION

1. Field of the Invention

The invention relates to a hydraulic tool and, more specifically, a hand-held, portable, battery-powered hydraulic tool.

2. Brief Description of Prior Developments

International PCT patent publication No. WO 03/084719 A2 discloses a hydraulic pressing device which is powered by a battery. Hydraulic power tools are employed in numerous applications to provide a user with a desired mechanical advantage. One example application is in crimping tools used for making crimping connections, such as crimping power connectors onto conductors. Another example application is in cutting tools where hydraulic power enables a user to apply a relatively large amount of force or pressure. In enabling such operations, it is generally desirable to provide a tool that can perform the desired operations, and is manageable as well. With regards to hydraulic power tools, this can often be difficult as conventional hydraulic tools are generally heavy and cumbersome to handle, at least partially owing to the high loads such tools are often subjected to during operation. Notwithstanding this cumbersome aspect of a conventional hydraulic tool, it is desirable that the hydraulic tool be portable and hand-held. Many operators prefer a battery-powered hydraulic tool since it forgoes manual pumping by the operator to actuate the hydraulics and, hence, involves less physical effort on the part of the operator to operate the tool.

Hydraulic power tools largely come in different configurations including, for example, a pistol configuration and an in-line configuration. U.S. Pat. No. 5,727,417 discloses a portable, in-line, battery-powered crimper. The longitudinal axis of the crimper's battery is in line with the tool longitudinal axis. The tool comprises one, long section wherein the tool longitudinal axis is aligned with the longitudinal axis of the crimper's working head. EP0860245 also discloses an in-line pressing tool with coupled jaws that are spring biased in a closed position.

SUMMARY OF THE INVENTION

In accordance with one aspect of the present invention, a hand-held, battery-powered, hydraulically-actuated tool is provided including a frame forming a tool longitudinal axis; a battery offset from the tool longitudinal axis; and located along the tool longitudinal axis a motor connected to the battery; a hydraulic fluid pump connected to the motor, such as by a transmission for example; a ram movably connected to the frame and adapted to be moved relative to the frame by hydraulic fluid pumped by the hydraulic fluid pump; and a working head adapted to be actuated by the ram. The tool includes a main section situated in an in-line configuration along the tool longitudinal axis. A center longitudinal axis of the battery is offset from the tool longitudinal axis.

In accordance with another aspect of the invention, a hand-held, battery-powered, hydraulically-actuated tool is provided comprising a frame; a motor connected to the frame; a hydraulic fluid reservoir connected to the frame; a hydraulic fluid pump connected to the hydraulic fluid reservoir and the motor; a ram adapted to be moved by hydraulic fluid pumped by the hydraulic fluid pump; and a working head adapted to be actuated by the ram. The tool comprises a first section and a second section. The first section comprises the working head and the ram. The second section comprises a battery. The first section has a first center longitudinal axis. The second section has a second center longitudinal axis. The first section is movably connected to the second section by a movable connection. The movable connection enables the tool to achieve at least two states comprising a first state and a second state. When in the first state the first center longitudinal axis is substantially parallel to the second center longitudinal axis. When in the second state the first center longitudinal axis is at an angle relative to the second center longitudinal axis.

In accordance with another aspect of the invention, a hand-held, battery-powered, hydraulically-actuated tool is provided comprising a frame; a motor connected to the frame; a hydraulic fluid reservoir connected to the frame; a hydraulic fluid pump connected to the hydraulic fluid reservoir and the motor; a ram movably connected to the frame and adapted to be moved relative to the frame by hydraulic fluid pumped by the hydraulic fluid pump; a working head adapted to be actuated by the ram; a battery connected to the motor; and a tool housing comprising a first section and a second section. The first section at least partially surrounds the ram, the hydraulic fluid pump, the motor, and the frame. The second section at least partially houses the battery. The first section is movably connected to the second section by a movable connection. The first section has a first center longitudinal axis and the second section has a second center longitudinal axis. The movable connection enables the tool to achieve at least two states comprising a first in-line state wherein the first center longitudinal axis is substantially parallel to the second center longitudinal axis and a second angled state. The first center longitudinal axis is angled relative to the second center longitudinal axis.

In accordance with another aspect of the invention, a hand-held, hydraulically-actuated tool is provided comprising a first section and a second section. The first section comprises a working head and a ram. The first section comprises a first end and a second end. The working head is located at the first end of the first section. The second section is connected to the first section by a first stationary connection. The second section comprises at least one of a motor, a hydraulic fluid reservoir, and a hydraulic fluid pump. The second section comprises a first end and a second end. The first end of the second section is connected by the first stationary connection to the second end of the first section. The first section has a first center longitudinal axis and the second section has a second center longitudinal axis, wherein the first center longitudinal axis is at an angle relative to the second center longitudinal axis.

In accordance with another aspect of the invention, a hand-held, hydraulically-actuated tool is provided comprising a first section, a second section and a third section. The first section comprises a working head and a ram. The first section comprises a first end and a second end. The working head is located at the first end of the first section. The second section is connected to the first section by a first stationary connection. The second section comprises a first end and a second end. The first end of the second section is connected by the first stationary connection to the second end of the first section. The third section is connected to the second section by a second stationary connection. The third section comprises a first end and a second end. The first end of the third section is connected by the second stationary connection to the second end of the second section. At least one of the second section and the third section comprises at least one of a motor, a hydraulic fluid reservoir, and a hydraulic fluid pump. The first section has a first center longitudinal axis. The second section has a second center longitudinal axis. The third section has a third center longitudinal axis. The first center longitudinal axis is at an angle relative to the second center longitudinal axis, and the third center longitudinal axis is at an angle relative to the second center longitudinal axis.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
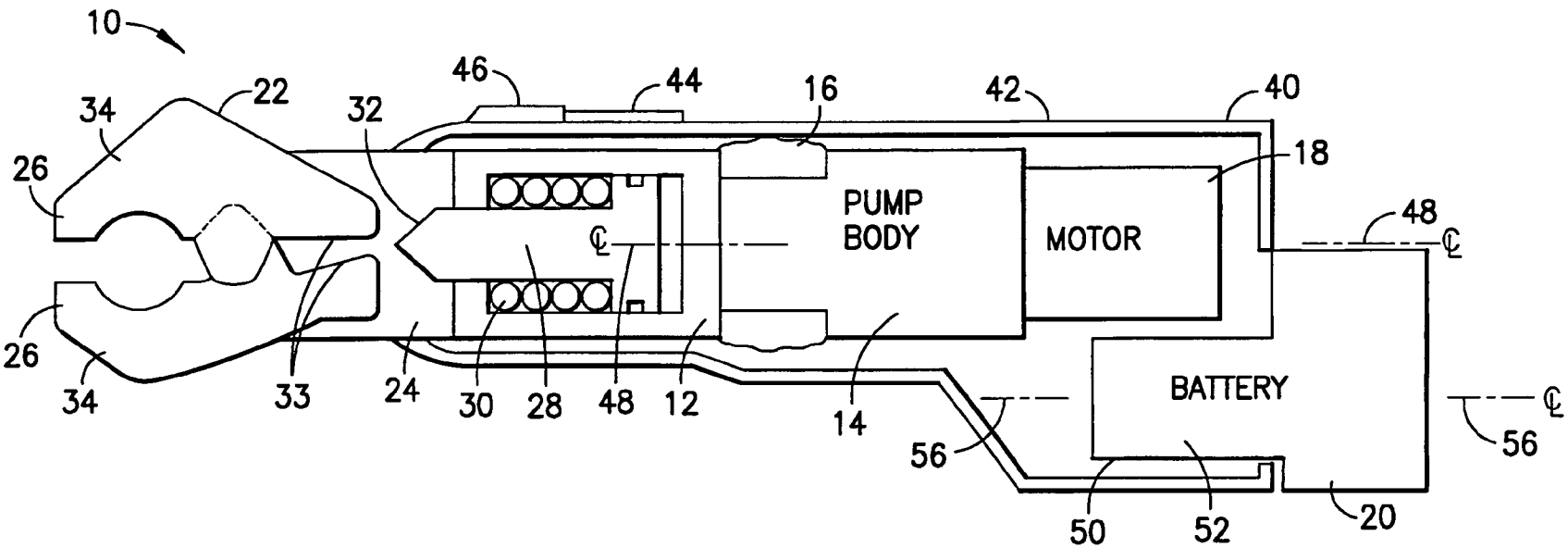
FIG. 1 is a schematic cross sectional diagram of a hydraulic tool incorporating features of the invention.

Referring to FIG. 1, there is shown a schematic cross sectional diagram of a battery operated hydraulic tool 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The tool 10, in the embodiment shown, generally comprises a hand-held battery operated crimping tool. However, features of the present invention could be used in other types of hand-held hydraulic tools, such as a hydraulic cutting tool. The tool 10 generally comprises a tool frame 12, a pump 14, a hydraulic fluid reservoir 16, an electric motor 18, a battery 20, and a working head 22. The working head 22, in the embodiment shown, comprises a frame 24, crimping jaws 26 pivotally connected to the frame 24, and a ram 28. The ram 28 is movably mounted on the frame 24. A spring 30 is provided to bias the ram 28 at a rearward position. The front end 32 of the ram 28 is adapted to wedge between rear ends 33 of the crimping jaws 26 to cause front ends 34 of the crimping jaws 26 to move towards each other. The ram 28 is adapted to be longitudinally moved on the frame 24 by hydraulic pressure acting on the rear of the ram from the pump 14. In an alternate embodiment, any suitable type of working head could be provided, such as described in U.S. Pat. No. 6,666,064 for example. In addition, the ram 28 can include rollers that contact the rear ends 33 of the crimping jaws 26, as shown in U.S. Pat. Nos. 6,457,338; 6,202,290; and 6,164,106, all of which are hereby incorporated by reference in their entirety. Alternatively, the rollers can be attached to the rear ends 33 of the crimping jaws 26.

Figure 2:
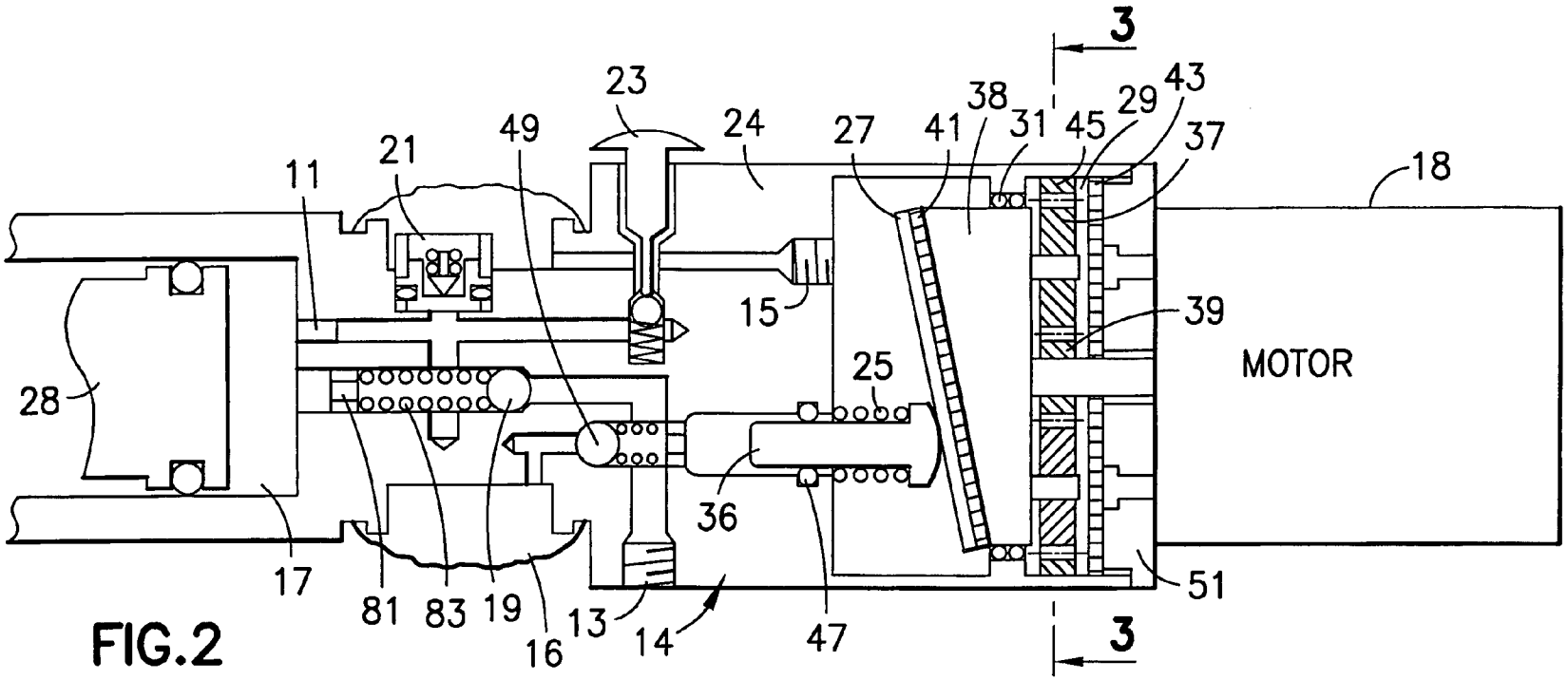
FIG. 2 is an enlarged partial view of portions of the tool shown in FIG. 1.
Figure 3:
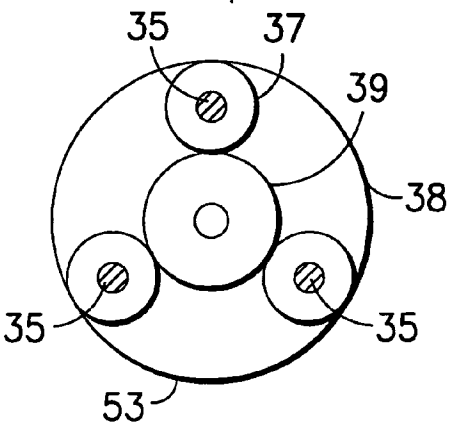
FIG. 3 is a partial cross sectional view of the tool shown in FIG. 2 take along line 3-3.

Referring also to FIGS. 2 and 3, in this embodiment the pump 14 comprises pistons 36 and a bevel disk 38. A similar pump is described in U.S. Pat. Nos. 6,446,482 and 6,453,719 which are hereby incorporated by reference in their entireties. However, any suitable type of pump could be provided, such as one described in U.S. Pat. No. 6,668,613, for example, which is hereby incorporated by reference in its entirety. The bevel disk 38 is adapted to be rotated by the motor 18. Rear ends of the pistons 36 are biased by piston springs 25 towards the bevel disk 38. As the bevel disk 38 is rotated by the motor 18, the sloped front face of the bevel disk 38 causes the pistons 36 to move in and out relative to the frame 24. This causes hydraulic fluid from the reservoir 16 to be pumped against the rear face of the ram 28. The conduit system in the frame has a jam screw 81 with a hole to allow fluid to pass through the jam screw, but the jam screw 81 functions as a back support for the spring 83. In this embodiment a transmission is provided between the motor 18 and the bevel disk 38 which comprises planet gears 37 on axles 35 and a sun gear 39. A ring gear 53 surrounds the planet gears. However, in alternate embodiments any suitable transmission could be provided.

As shown in FIG. 2, the tool 10 comprises plugs 11, 13, 15. The ram 28 lies within a cylinder 17. The conduit system comprises an outlet check valve 19, a pressure relief valve 21, a release plunger drain valve 23, and an inlet check valve 49. An o-ring 47 effects a seal around the piston 36. The bevel disk 38 has bearings 31 around it, in addition to thrust washers 27, 29 and thrust bearings 41, 43. A ring gear 45 is located near the rear face of the bevel disk 38. A motor mount plate 51 lies between the motor 18 and the bevel disk 38.

Referring back to FIG. 1, the tool 10 comprises an exterior housing 40. The exterior house 40 comprises a section 42 which is adapted to be grasped by a hand of the user, similar to a user grasping a rod shaped structure. An actuation trigger 44 is located on the exterior housing 40 in front of or at the section 42. The trigger 44 is connected to an electrical switch 46. With a user grasping the section 42 the user can actuate the trigger 44 with the user's thumb.

In the exemplary embodiment shown in FIGS. 1-3, the working head 22, ram 28, pump 14 and motor 18 are substantially aligned along a tool longitudinal axis 48. The battery 20 is preferably removably connected to the housing 40 at a rear end of the housing. However, in an alternate embodiment the battery might not be removably connected to the housing. The battery 20 is preferably a rechargeable battery. The tool comprises a suitable electrical system for coupling the battery 20 to the motor 18 via the switch 46, and preferably with a controller, such as a microprocessor on a printed circuit board, for example. In this exemplary embodiment, the housing 40 comprises a receiving area 50 which is adapted to receive a portion 52 of the battery. The battery portion 52 is adapted to be inserted into the receiving area 50 to assist in fixedly mounting the battery 20 to the tool 10. In this embodiment, a center longitudinal axis 56 of the battery 20 extends along the portion 52 and is located offset from the tool longitudinal axis 48.

Figure 4:
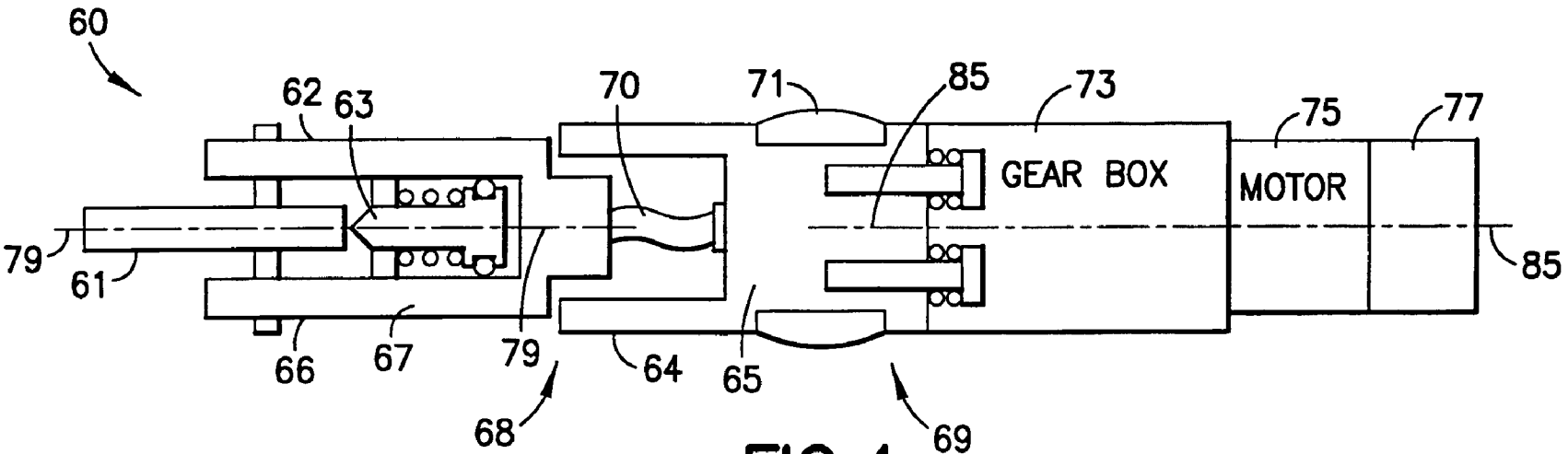
FIG. 4 is a schematic diagram of an alternate embodiment of the invention.
Figure 5:
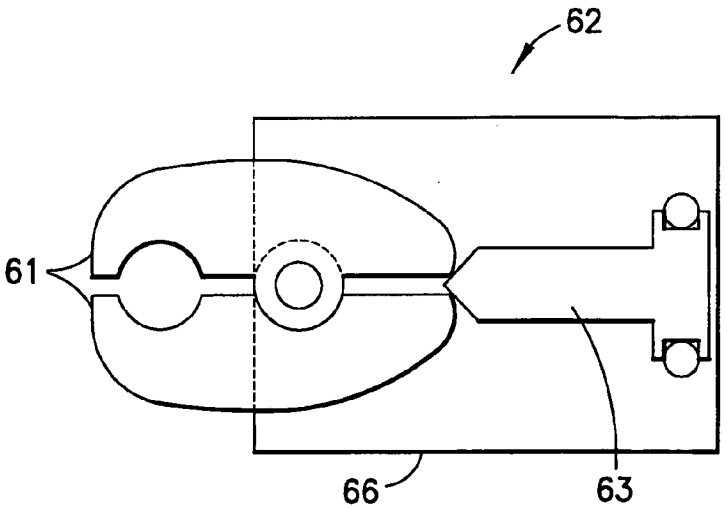
FIG. 5 is a schematic diagram of the working head of the tool shown in FIG. 4.
Figure 6:
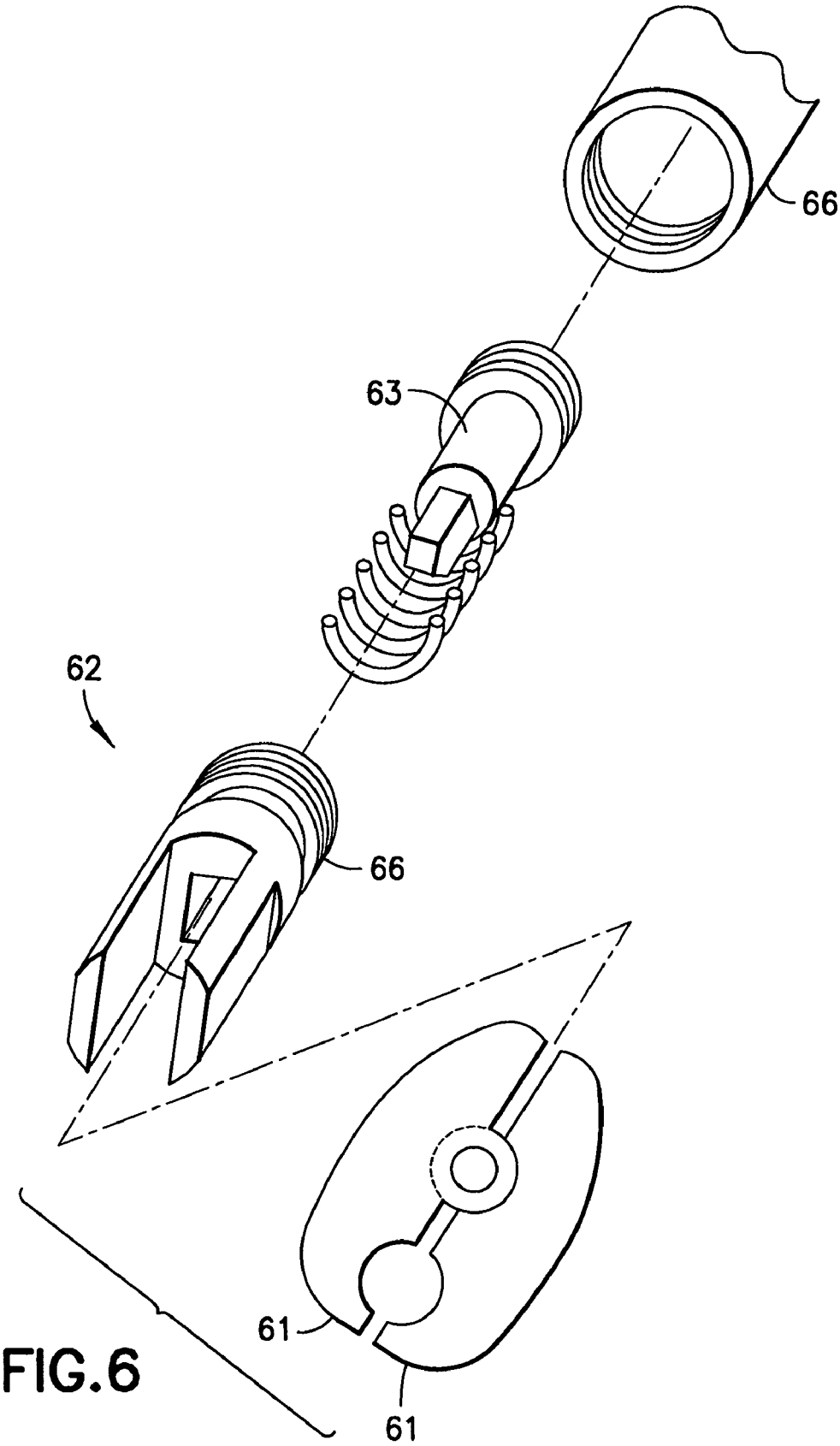
FIG. 6 is a partial exploded view of the working head of the tool shown in FIGS. 4-5.

Referring now to FIGS. 4-6, one alternate embodiment of the invention is shown. In this exemplary embodiment the tool 60 comprises a working head 62 which is movably attached to the frame 64 having the pump 65. The working head 62 is substantially similar to the working head 22 of FIGS. 1-3. Jaws 61 are pivotally connected to the working head frame 66, said working head frame 66 comprising a cylinder yoke 67. The ram 63 is substantially aligned along a center longitudinal axis 79 of the working head 62. The jaws 61 are adapted to be moved by the longitudinal movement of the ram 63 on the working head frame 66. However, the working head frame 66 is pivotally attached to the frame 64 at a joint 68. Any suitable type of pivotable connection could be provided. The joint 68 allows the working head 62 to pivot relative to the frame 64 and rear portion 69 of the tool 60.

A conduit connection 70 is provided between the pump 65 and the hydraulic fluid conduit system of the working head frame 66. In the exemplary embodiment shown, the conduit connection 70 comprises a hydraulic hose. In an alternate embodiment, the conduit connection could comprise any suitable type of conduit system which compensates for movement of the working head 62 relative to the frame 64 and rear portion 69. For example, in an alternate embodiment the joint and conduit connection could comprise a ball swivel type of connection with a suitable sealing structure.

The rear portion 69 of the tool 60 comprises the pump 65, annular reservoir 71, gearbox 73, motor 75, and battery 77. In this exemplary embodiment, the pump 65, gearbox 73, motor 75, and battery 77 are substantially aligned along a center longitudinal axis 85 of the rear portion 69. In alternate embodiments the pump 65, gearbox 73, motor 75, and battery 77 may not be substantially aligned along the center longitudinal axis 85 of the rear portion 69. The joint 68 that allows the working head 62 to pivot relative to the frame 64 and rear portion 69 of the tool 60 further enables the center longitudinal axis 79 of the working head 62 to pivot relative to the center longitudinal axis 85 of the rear portion 69.

Figure 7:
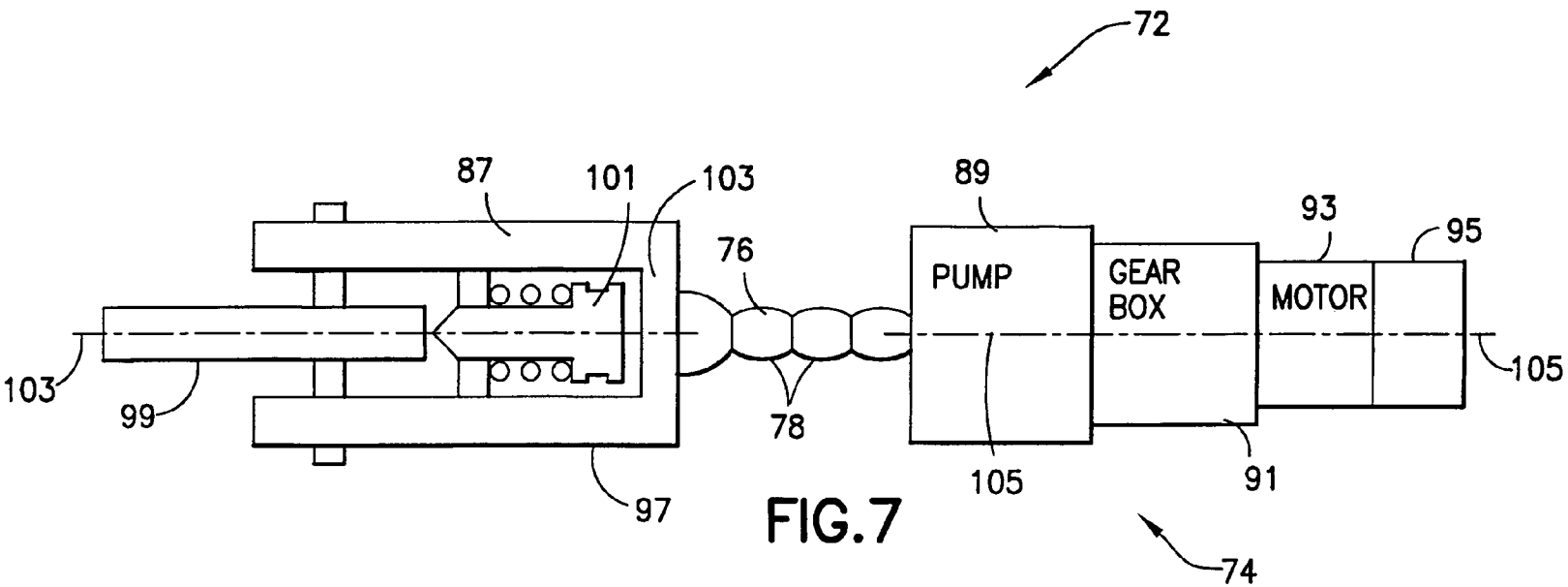
FIG. 7 is a schematic diagram of an alternate embodiment of a tool incorporating features of the invention.

Referring now to FIG. 7, another alternate embodiment of the invention is shown. In this exemplary embodiment the tool 72 comprises a working head 87 which is connected to the rear portion 74 of the tool 72 by a connection 76. The working head 87 comprises jaws 99 and a ram 101. The ram 101 is substantially aligned along a center longitudinal axis 103 of the working head 87. The rear portion 74 of the tool 72 could comprise identical components as those shown in FIGS. 2 and 3 with the exception that the front of the frame would end at about the jam screw 81. The rear portion 74 of the tool 72 comprises the pump 89, gearbox 91, motor 93, and battery 95. In this exemplary embodiment, the pump 89, gearbox 91, motor 93, and battery 95 are substantially aligned along a center longitudinal axis 105 of the rear portion 74. In alternate embodiments the pump 89, gearbox 91, motor 93, and battery 95 may not be substantially aligned along the center longitudinal axis 105 of the rear portion 74.

The connection 76 comprises a jointed link snakehead design. More specifically, the connection 76 comprises a plurality of links 78 which are connected to each other in series. The links 78 are pivotally connected to adjacent links. The links 78 also provide a path for conducting hydraulic fluid between the pump 89 and the hydraulic conduit system in the frame 97. In a preferred embodiment, a hydraulic hose extends through channels of the links 78. The hydraulic hose would be coupled to the frame 97 at about the jam screw 81 to attach the hose to the frame 97, such as screwed into the frame 97. The links 78 can be articulated relative to each other to relocate the working head 87 relative to the rear portion 74 of the tool 72. In such a manner, the center longitudinal axis 103 of the working head 87 may be offset, angled or both offset and angled from the center longitudinal axis 105 of the rear portion 74 of the tool 72.

Figure 8:
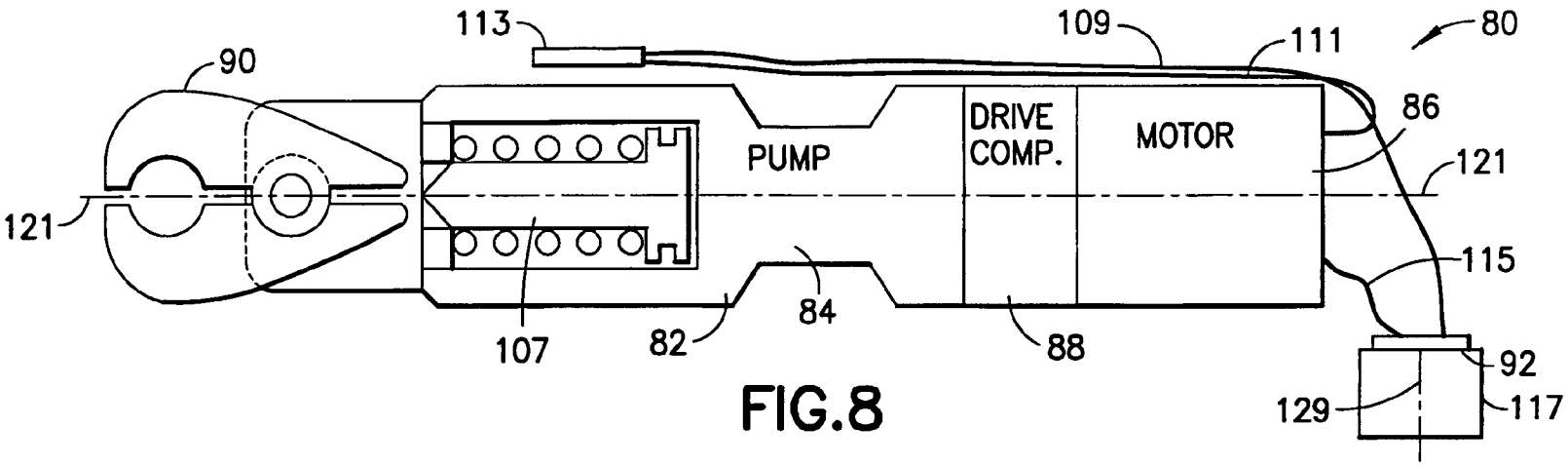
FIGS. 8 and 9 are schematic diagrams of components of an alternate embodiment of the tool incorporating features of the invention.
Figure 9:
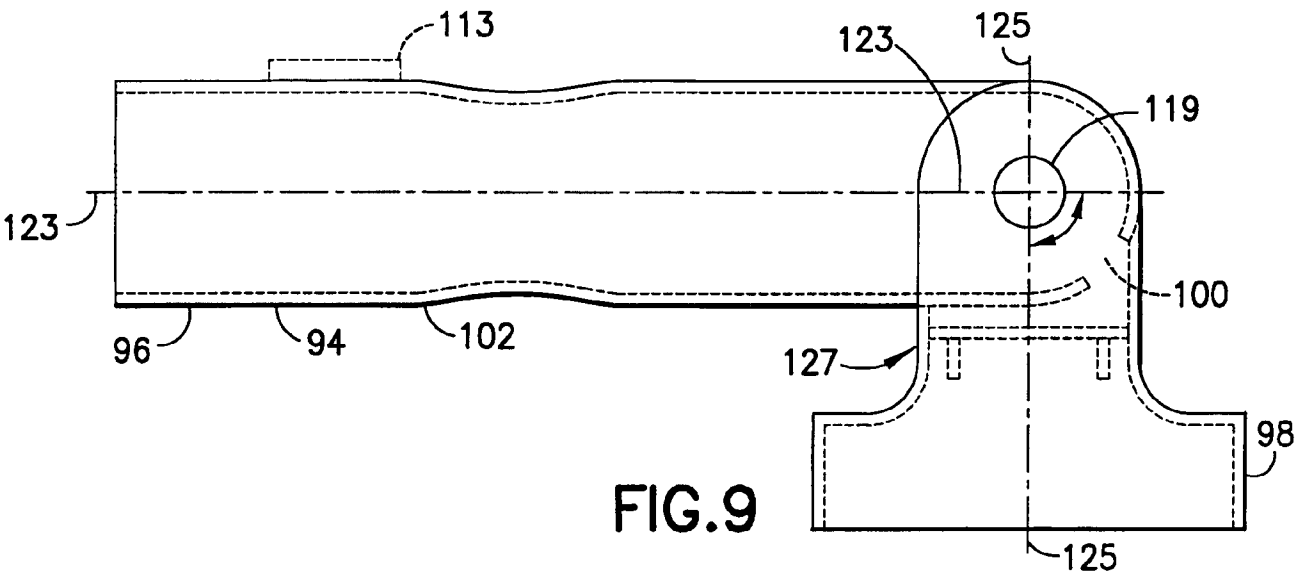

Referring now to FIGS. 8 and 9, another alternate embodiment of the invention is shown. FIG. 9 shows an outer housing assembly 94 of the tool 80 and FIG. 8 shows the working head 90 and inner working components of the tool 80. In this exemplary embodiment the inner working components of the tool 80 comprise a frame 82, a pump 84, and a motor 86 connected to the pump by a transmission 88. The working head 90 comprises a portion of the frame 82 which houses the ram 107. The construction of the working head 90 is substantially identical to the working head shown in FIG. 6 with the exception that the frame 66 is not provided. Instead, the function of the frame 66 is provided by a front portion of the frame 82. The working head 90 and inner working components are substantially aligned along a center longitudinal axis 121. Alternate embodiments of the invention may not have the working head 90 and all of the inner working components substantially aligned along the center longitudinal axis 121. An electrical connector 92 is provided with wires 109, 111 and 115 to electrically connect a battery 117 to the motor 86 and switch 113.

The outer housing assembly 94 generally comprises a first section 96 and a second section 98. The first section 96 is adapted to be mounted around the frame 82, pump 84, motor 86 and transmission 88. The hydraulic fluid reservoir can be located at area 96 at an exterior side of the frame 82 at least partially around the pump 84. The first section 96 has a center longitudinal axis 123. When the first section 96 is mounted around the frame 82, pump 84, motor 86 and transmission 88, the center longitudinal axis 123 of the first section is substantially aligned with the center longitudinal axis 121 of the working head 90 and inner working components. The second section 98 is rotatably connected to the rear end of the first section 96 and has a center longitudinal axis 125. The second section 98 is preferably adapted to pivot about 90 degrees about pivot point 119 between a down position as shown in FIG. 9 and an in-line position substantially in-line with the first section 96. The electrical connector 92 is located in the second section 98 and the electrical wires between the electrical connector 92, switch 113 and motor 86 extend through an opening 100 at the rear of the first section 96. Alternate embodiments may have the second section 98 configured in a different shape, such as a cylinder for example.

The second section 98 is adapted to removably receive a rechargeable battery 117. When the rechargeable battery 117 is received by the second section 98, a center axis 129 of the rechargeable battery 117 is substantially aligned with the center longitudinal axis 125 of the second section 98. Alternate embodiments of the invention may not have the center axis 129 of the rechargeable battery 117 aligned with the center longitudinal axis 125 of the second section 98 when the battery is received by the second section. With the second section 98 located in its down position as shown in FIG. 9, the second section 98 and rechargeable battery 117 can form a handle grip 127 for the tool 80 at the rear of the tool. This forms downward handle type of configuration. Thus, the user can grasp the tool at the second section 98 with a first hand and actuate the switch 113 with a second hand. Alternatively, the second section 98 can be rotated into an in-line position with the first section 96, and the user can grip the tool at a hand to grasp section 102 on the first section 96 and actuate the switch 113 with a thumb of the same hand. This forms an in-line type of configuration. Thus, the tool 80 can be used in either an in-line configuration or in a downward-extending handle configuration.

As can be observed in FIGS. 8 and 9, when the rechargeable battery 117 is housed in the second section 98, by rotating the second section 98 relative to the first section 96, the center axis 129 of the rechargeable battery 117, and the center longitudinal axis 125 of the second section 98, rotate relative to the center longitudinal axis 123 of the first section 96. In such a manner, the center axis 129 of the rechargeable battery 117 may shift from a position about 90 degrees to the center longitudinal axis 123 of the first section 96, as in the downward-extending handle configuration, to a position about aligned with or parallel to the center longitudinal axis 123 of the first section 96, as in the in-line configuration.

Figure 10:
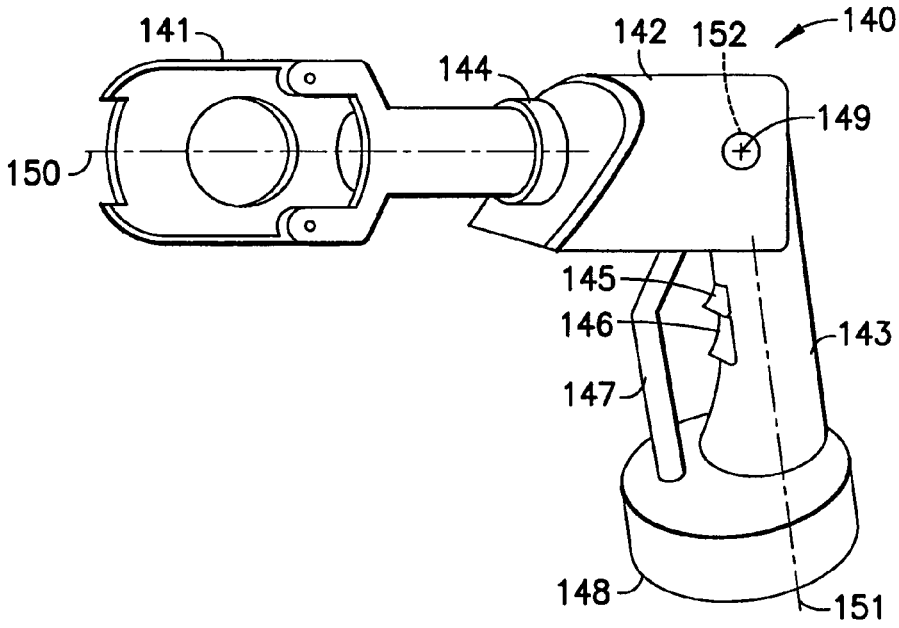
FIG. 10 is a perspective view of another alternate embodiment of the tool in a pistol configuration incorporating features of the invention.
Figure 11:
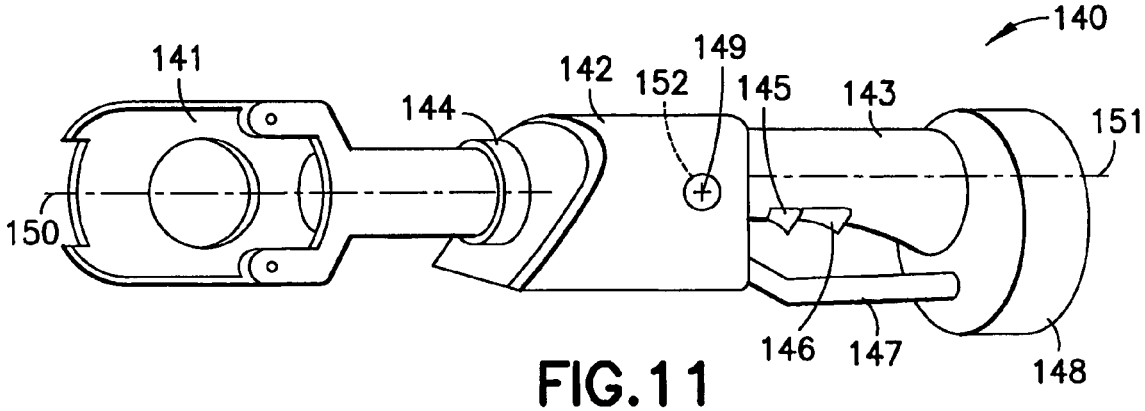
FIG. 11 is a perspective view of the embodiment shown in FIG. 10 after the tool has been shifted to an in-line configuration.

Referring to FIGS. 10 and 11, another alternate embodiment of the invention is shown. The working head 141 comprises cutting jaws adapted to cut a cable or bar. The working head 141 is enabled to rotate about a center longitudinal axis 150 relative to the first section 142. The tool 140 is adapted to shift between an in-line configuration (FIG. 11) and a pistol configuration (FIG. 10). The tool 140 comprises three portions: the working head 141, a first section 142, and a second section 143. The working head 141 is rotatively connected to the first section 142 by a rotative connection 144. The rotative connection 144 enables the working head 141 to rotate about a center longitudinal axis 150 relative to the first section 142. The rotative connection 144 may be of any suitable type or design that enables the rotative movement of the working head 141. Alternate embodiments may not include the rotative connection 144. The second section 143 comprises actuation triggers 145, 146 and a trigger guard 147. The bottom end of the second section 143 is adapted to receive a rechargeable battery 148. The rechargeable battery 148 has a center axis 151. Axis 151 is also the axis of mounting the battery to the tool.

The second section 143 is connected to the first section 142 by a pivotal connection 152 and may pivot about pivot point 149 relative to the first section 142. In such a manner the tool 140 may achieve multiple configurations. The pivotal connection 152 may be of any suitable type or design that enables the pivotal movement. The tool 140 may be shifted between a pistol configuration (FIG. 10) and an in-line configuration (FIG. 11). In the in-line configuration, the center axis 151 of the rechargeable battery 148 is about aligned with the center longitudinal axis 150 of the working head 141 and first section 142. In the pistol configuration, the center axis 151 of the rechargeable battery 148 is at an angle from the center longitudinal axis 150 of the working head 141 and first section 142. Alternate embodiments may not have the center axis 151 of the rechargeable battery 148 aligned with the center longitudinal axis 150 of the working head 141 or first section 142 when the tool 140 is in a pistol configuration. Other alternate embodiments may not have the center longitudinal axis of the working head aligned with the center longitudinal axis of the first section 142. Still other alternate embodiments of the tool 140 may not comprise a trigger guard 147 and/or may comprise a fewer or greater number of triggers than two.

Figure 12:
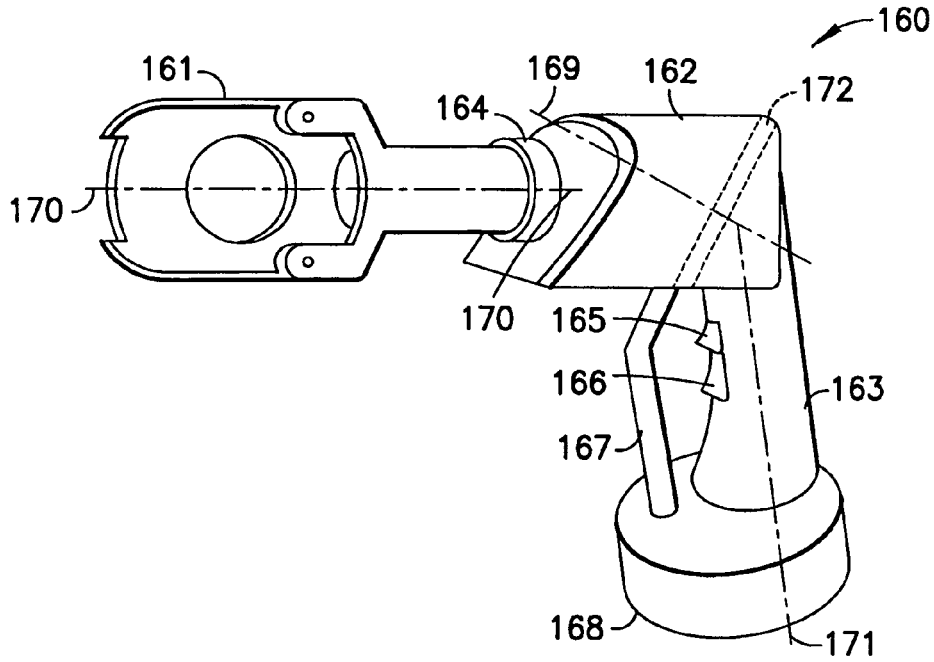
FIG. 12 is a perspective view of another alternate embodiment of the tool in a pistol configuration incorporating features of the invention.
Figure 13:
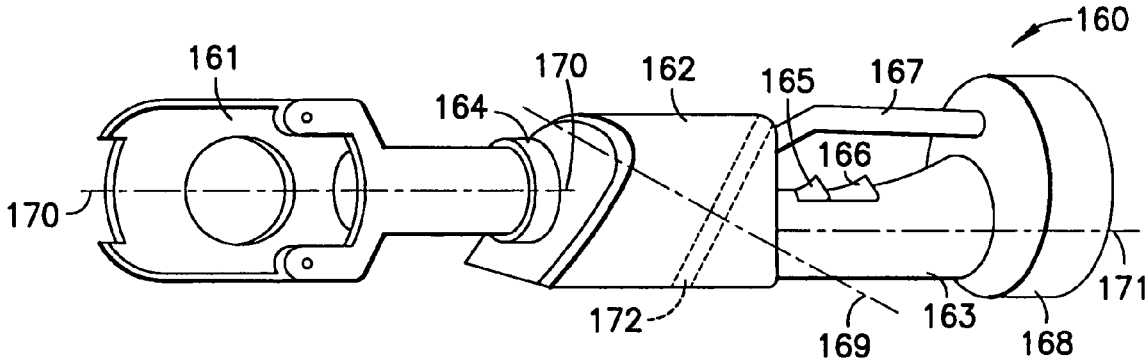
FIG. 13 is a perspective view of the embodiment shown in FIG. 12 after the tool has been shifted to an in-line configuration.

FIGS. 12 and 13 illustrate another alternate embodiment of the invention. The tool 160 is substantially similar to the tool 140 shown in FIGS. 10 and 11 with the exception that the pivot point 149 has been replaced by a rotative axis 169. As with the tool 140 of FIGS. 10 and 11, the tool 160 is enabled to shift between an in-line configuration (FIG. 13) and a pistol configuration (FIG. 12). The tool 160 comprises three portions: the working head 161, a first section 162, and a second section 163. The working head 161 is rotatively connected to the first section 162 by a rotative connection 164. The rotative connection 164 enables the working head 161 to rotate about a center longitudinal axis 170 relative to the first section 162. The rotative connection 164 may be of any suitable type or design that enables the rotative movement of the working head 161. Alternate embodiments might not include the rotative connection 164. The second section 163 comprises actuation triggers 165, 166 and a trigger guard 167. The bottom end of the second section 163 is adapted to receive a rechargeable battery 168. The rechargeable battery 168 has a center axis 171.

The second section 163 is connected to the first section 162 by a rotative connection 172 and may rotate about a rotative axis 169 relative to the first section 162. In such a manner the tool 160 may achieve multiple configurations. The rotative connection 172 may be of any suitable type or design that enables the rotative movement. The tool 160 may be shifted between a pistol configuration (FIG. 12) and an in-line configuration (FIG. 13). In the in-line configuration, the center axis 171 of the rechargeable battery 168 is substantially aligned with the center longitudinal axis 170 of the working head 161 and first section 162. In the pistol configuration, the center axis 171 of the rechargeable battery 168 is at an angle from the center longitudinal axis 170 of the working head 161 and first section 162. Alternate embodiments might not have the center axis 171 of the rechargeable battery 168 aligned with the center longitudinal axis 170 of the working head 161 or first section 162 when the tool 160 is in a pistol configuration. Other alternate embodiments might not have the center longitudinal axis of the working head aligned with the center longitudinal axis of the first section 162. Still other alternate embodiments of the tool 160 might not comprise a trigger guard 167 and/or may comprise a fewer or greater number of triggers than two.

Figure 14:
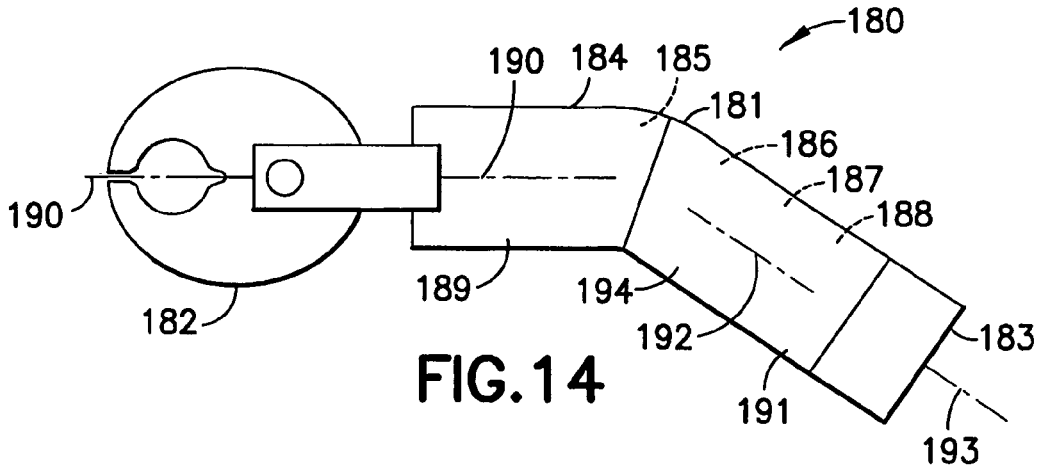
FIG. 14 is a side view of another alternate embodiment of the tool incorporating features of the invention.

Referring now to FIG. 14, another alternate embodiment of the invention of shown. In this embodiment the tool 180 comprises a main body 181, a working head 182 and a removable rechargeable battery 183. The main body 181 comprises an exterior housing 184. Located inside the exterior housing 184 is the frame 185, pump 186, transmission 187 and motor 188 similar to the embodiments described above. The exterior housing 184 comprises a general bent shaped as shown. This provides a first section 189 which has a center longitudinal axis 190 substantially aligned with the working head 182, and a second section 191 which is angled relative to the first section 189, such as at an angle of about 25-45 degrees for example. The second section 191 is stationary relative to the first section 189 and has a center longitudinal axis 192.

The removable rechargeable battery 183 has a center axis 193. When connected to the second section 191, the center axis 193 of the removable rechargeable battery 183 is substantially aligned with the center longitudinal axis 192 of the second section 191. In such a manner, the center axis 193 of the removable rechargeable battery 183 is at an angle from the center longitudinal axis 190 of the first section 189 and working head 182.

Alternate embodiments might not have the center axis 193 of the removable rechargeable battery 183 substantially aligned with the center longitudinal axis 192 of the second section 191 when the removable rechargeable battery 183 is connected to the second section 191. Other alternate embodiments might not have the center longitudinal axis 190 of the first section 189 substantially aligned with the working head 182.

The user actuated switch(es) could be located on the first section 189 and/or the second section 191. This type of embodiment can provide a shorter longitudinal length tool and a shorter height tool, but with an ergonomic hand grip area 194 provided by the second section 191. The ergonomic hand grip area 194 may be located anywhere along the second section 191 where it will facilitate easier gripping and handling of the tool 180. Alternate embodiments may locate the ergonomic hand grip area 194 on the first section 189 of the tool 180.

Figure 15:
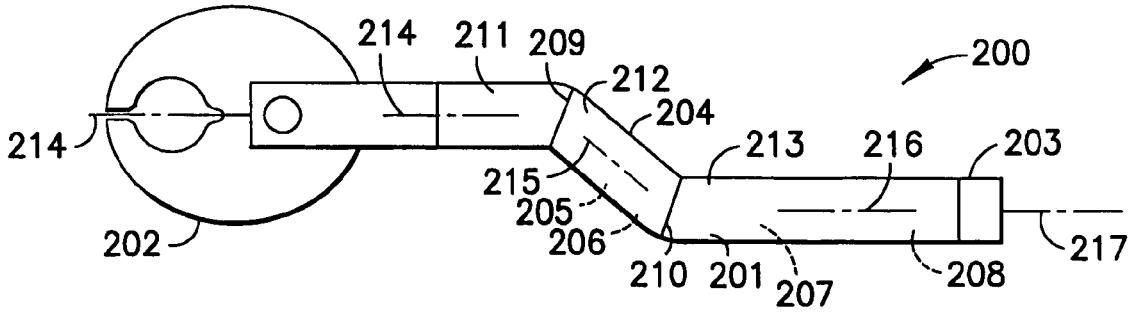
FIG. 15 is a side view of another alternate embodiment of the tool incorporating features of the invention.

Referring also to FIG. 15, another alternate embodiment of the invention is shown. In this embodiment the tool 200 comprises a main body 201, a working head 202 and a removable rechargeable battery 203. The main body 201 comprises an exterior housing 204. Located inside the exterior housing 204 is the frame 205, pump 206, transmission 207 and motor 208 similar to the embodiments described above. The exterior housing 204 comprises a general bent shape as shown, similar to a Z shape with two bent areas 209, 210. This provides a tool 200 with three sections 211, 212, 213. The first section 211 has a center longitudinal axis 214 substantially aligned with the working head 202. The second section 212 has a center longitudinal axis 215 and is angled relative to the first section 211, such as at angle of about 25-45 degrees for example. The third section 213 has a center longitudinal axis 216 and is angled relative to the second section 212, such as at an angle of about 25-45 degrees for example. In a preferred embodiment, the third section 213 is parallel to the first section 211. However, in an alternate embodiment, the first and third sections might not be parallel.

The removable rechargeable battery 203 has a center axis 217. When connected to the third section 213, the center axis 217 of the removable rechargeable battery 203 is substantially aligned with the center longitudinal axis 216 of the third section 213. In such a manner, the center axis 217 of the removable rechargeable battery 203 is offset from the center longitudinal axis 214 of the first section 211 and working head 202.

Alternate embodiments might not have the center axis 217 of the removable rechargeable battery 203 substantially aligned with the center longitudinal axis 216 of the third section 213 when the removable rechargeable battery 203 is connected to the third section 213. Other alternate embodiments might not have the center longitudinal axis 214 of the first section 211 substantially aligned with the working head 202.

The second section 212 is stationary relative to the first section 211. The third section 213 is stationary relative to the second section 212. The user actuated switch(es) could be located on the first section 211 and/or the second section 212 and/or the third section 213. This type of embodiment can provide a shorter longitudinal length tool and a shorter height tool, but with an ergonomic hand grip area provided by the second section 212 and/or the third section 213. Alternate embodiments may locate the ergonomic hand grip area on the first section 211 of the tool 200.

Figure 16:
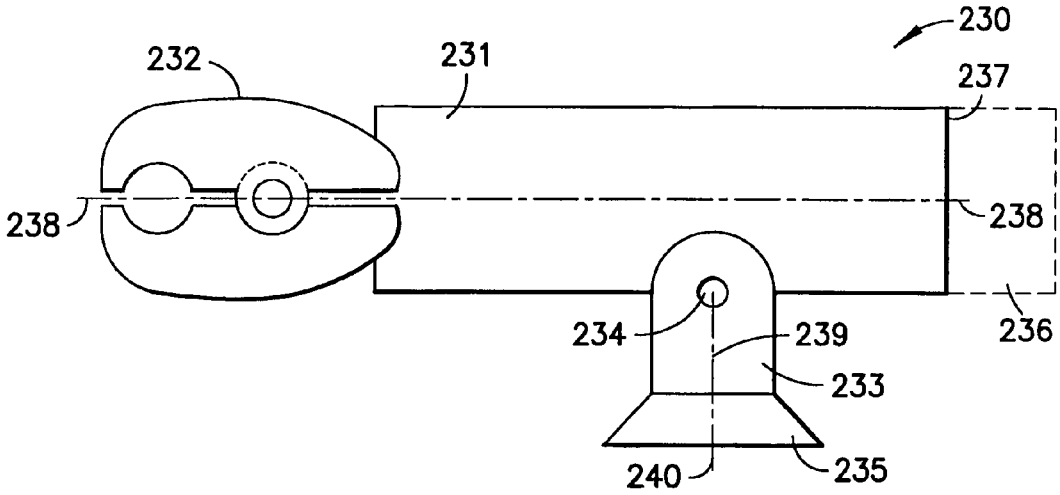
FIG. 16 is a side view of another alternate embodiment of the tool incorporating features of the invention.

Referring now to FIG. 16, another alternate embodiment of the invention is shown. In this embodiment the tool 230 comprises a main section 231, a working head 232 and a swivel handle 233. The main section 231 comprises the motor, transmission, pump and a portion of the frame of the working head 232. The swivel handle 233 is movably attached to the main section 231, such as at a pivot joint 234. The swivel handle 233 can be moved by a user between a down position as shown in FIG. 16, wherein the swivel handle 233 extends down from the main section 231, and an up position wherein the swivel handle 233 is substantially parallel with the main section 231. The swivel handle 233 can be adapted to attach the battery 235 to the tool 230. The main section 231 can comprise an optional battery receiving area 236. The receiving area 236 can be located at a rear end 237 of the main section 231. The tool 230 can be adapted to locate one or two batteries at the swivel handle 233 and/or directly on the main section 231. Alternate embodiments may locate the optional battery receiving area 236 elsewhere on the main section 231 of the tool 230.

The main section 231 of the tool 230 has a center longitudinal axis 238 substantially aligned with the working head 232. The swivel handle 233 has a center longitudinal axis 239. The battery 235 has a center axis 240. When the battery 235 is attached to the swivel handle 233, the center axis 240 of the battery 235 is substantially aligned with the center longitudinal axis 239 of the swivel handle 233. Because the swivel handle 233 can be moved by a user between a down position (FIG. 16) and an up position (wherein the swivel handle 233 is substantially parallel with the main section 231), the center axis 240 of the battery 235 may shift between a position wherein the center axis 240 is angled from the center longitudinal axis 238 of the main section 231 (the down position, FIG. 16) and a position wherein the center axis 240 of the battery 235 is substantially parallel to the center longitudinal axis 238 of the main section 231 (the up position).

Alternate embodiments might not have the center longitudinal axis 238 of the main section 231 substantially aligned with the working head 232. Other alternate embodiments may not have the center axis 240 of the battery 235 substantially aligned with the center longitudinal axis 239 of the swivel handle 233.

Figure 17:
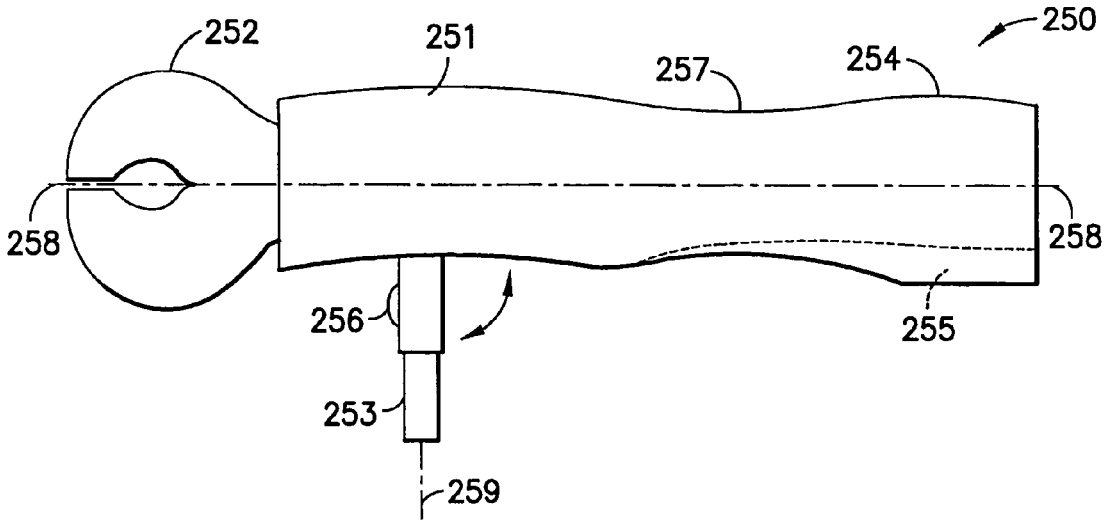
FIG. 17 is a side view of another alternate embodiment of the tool incorporating features of the invention.

Referring now to FIG. 17, another alternate embodiment of the invention shown. In this embodiment the tool 250 comprises a main section 251, a working head 252 and a handle 253. The tool 250 has a tool longitudinal axis 258 and the handle has a handle longitudinal axis 259. The main section 251 comprises the motor, transmission, pump, battery and the frame which includes a hydraulic section of the working head 252. The components in the main section 251 are substantially similar to those shown and described with respect to FIGS. 1-3. The center longitudinal axis of the battery could be offset from the tool longitudinal axis 258, or it could be aligned.

The main section 251 further comprises an exterior housing 254. The exterior housing 254 comprises a recessed area 255. The recessed area 255 is located at the bottom side of the exterior housing 254 at the middle and rear of the main section 251. The recessed area 255 is sized and shaped to receive a portion of a user's forearm therein. The handle 253 is pivotally attached to the main section 251 and may shift between an extended position as shown in FIG. 17 and a collapsed position against the main section 251. The main section 251 could comprise a recess for substantially enclosing the handle 253 when the handle 253 is at its collapsed position. The handle 253 preferably comprises a trigger 256.

When the handle 253 is in its extended position as shown in FIG. 17, the user can locate his forearm in the recessed area 255, grasp the handle 253 with his hand, and actuate the trigger 256 with the same hand. Locating the user's forearm in the recessed area 255 provides additional stability of connection of the tool 250 with the user. In an alternate embodiment, the main section 251 could comprise an extension which is adapted to engage a portion of the user's forearm or wrist. In its extended position, the handle longitudinal axis 259 is about orthogonal to the tool longitudinal axis 258.

When the handle 253 is in its collapsed position, the user can grasp the main section 251 at hand grasp area 257. The handle 253 and trigger 256 would be located at the bottom of the hand grasp area 257. Thus, the user can actuate the trigger 256 with a finger while grasping the hand grasp area 257 with the same hand. This embodiment allows the tool 250 to be used in either a handle extended position or a handle retracted position, with the user grasping the tool 250 either at the handle 253 or at the hand grasp area 257, respectively. In its collapsed position, the handle longitudinal axis 259 is about parallel to the tool longitudinal axis 258.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention.

Furthermore, some of the features of the preferred embodiments of this invention could be used to advantage without the corresponding use of other features. As such, the foregoing description should be considered as merely illustrative of the principles of the present invention, and not in limitation thereof.

The invention fulfills the desire to provide a hand-held, portable, battery-powered hydraulic tool that is manageable by a user. To accomplish this, a centerline of the battery may be offset from a longitudinal centerline of the tool. Exemplary embodiments further comprise a movable handle attached to the main section of the tool. In alternate exemplary embodiments, the tool may comprise a plurality of sections connected to each other such that the tool may be manipulated to achieve multiple configurations or states, at least one of which enables a longitudinal axis of one section to be offset, at an angle or both offset and at an angle from a longitudinal axis of a different section. Exemplary embodiments further provide a connection between the plurality of sections wherein the connection comprises a pivot connection, a ball swivel connection or a jointed link snakehead design, as examples. Alternate exemplary embodiments provide a tool in which the sections are stationary with respect to each other, each section's center longitudinal axis being at an angle from the center longitudinal axes of adjacent sections.

Figure 18:
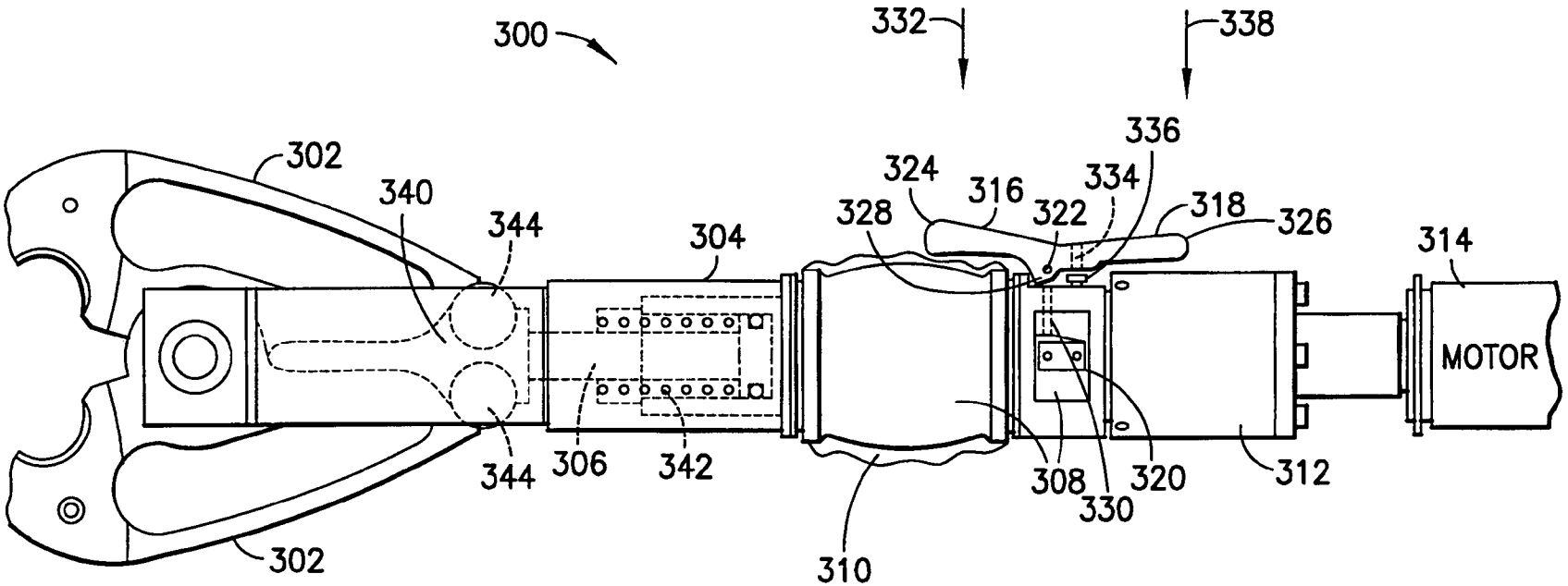
FIG. 18 is a partial side view of an alternate embodiment of a tool with the outer housing removed.

Referring now to FIG. 18, there is shown a side view of a portion of an alternate embodiment of a tool 300 incorporating features of the invention, but with its outer housing removed. The tool 300 is essentially an in-line (or at least partially in-line) type of compression tool for crimping an electrical connector onto a conductor. However, the crimp jaws 302 could be replaced by cutting blades for a cutting tool. The tool 300 generally comprises a frame 304, a movable ram 306, a pump 308, a hydraulic fluid reservoir 310, a transmission 312, a motor 314, a user control 316 and a battery (not shown).

In this embodiment the user control 316 comprises a rocker member 318 and a switch 320. The rocker member 318 has middle section 322 pivotably connected to the frame 304, a front section 324 and a rear section 326. The bottom of the rocker member 318 comprises a cam profile 328. An activation rod 330 is provided between the cam profile 328 and the switch 320. When the front section 324 is depressed as indicated by arrow 332, the cam profile 328 can move the activation rod 330 inward to actuate the switch 320. The switch 320 is coupled to the battery and the motor 314 to control actuation of the motor. The rocker member 316 is preferably spring biased at a neutral position.

The reservoir generally comprises an annular configured reservoir surrounding a section of the Pump Body. The frame 304 includes a yoke 340. A jaw assembly is provided with the jaws 302. A spring 342 is provided on the ram 306. The ram 306 includes rollers 344 for moving the jaws 302 as the ram 306 is extended. The front section 324 forms an activation trigger. The rear section 326 forms a retract trigger. The activation trigger and the retract trigger form a Rocker Control. The top of the release valve has a release button.

The rear section 326 of the rocker member 316 has a surface 334 located directly above the top of a pump release valve 336. When the rear section 326 is depressed as indicated by arrow 338, the surface 334 can move the pump release valve 336 inward to release hydraulic fluid from behind the ram 306 back to the reservoir 310.

The switch is shown less its electrical wires. However, the wires would typically be configured to have one wire routed from the switch to the battery and the other wire from the switch to the motor. Alternatively, routings may include an electrical circuit thereby controlling the power ON/OFF power operation. The activation trigger and release button are shown in the form of a rocker switch, however, other configurations are possible. The rocker switch could easily be spring biased to the neutral position as shown.

Figure 19:
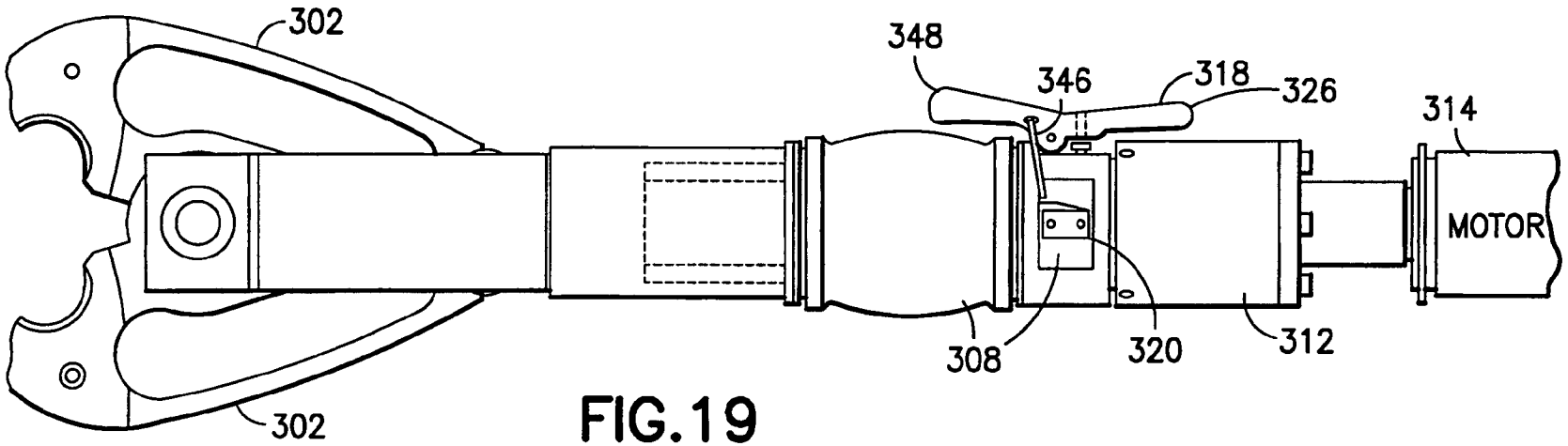
FIG. 19 is a partial side view similar to FIG. 18 of another alternate embodiment of the tool with the outer housing removed.

The rocker switch, when pushed on the end section closest to the crimp jaws, activates the operation of the tool. The rocker switch can incorporate a cam profile to push on the activation rod that easily activates the electrical switch. In a similar fashion an activation rod 346 could easily be attached to the rocker member 348 directly as portrayed in FIG. 19. Yet another option may be to have an arm extend directly off of the rocker control. In both FIGS. 18 and 19 the rocker control is located over the pump body section of the tool and is of considerable distance away from the front face of the motor. Likewise the switch is located on or adjacent to the pump body and is located a considerable distance (a distance of greater than four finger widths) from the front face of the motor. If the switch is located adjacent to the pump body the switch could be located in the plastic housing that will wrap the majority of the tool and provide an ergonomic interface for the operator.

The tool housing would have a grip region to be primarily over the gearbox and extend to the pump body section with a minor portion extending rearward over the motor. Another feature of the invention is the distance from the crimp groove to the rocker control. When the tool is used to crimp between live conductors, it is preferred to have a large distance as possible from the crimp groove to the hand of the operator. When the rocker control is actuated the motor spins the gears inside the transmission which moves the bevel disk. The bevel disk pushes on a wobble plate which causes the piston pump to reciprocate in a linear fashion. As a result the piston pump draws fluid from the reservoir and pumps it to section behind the piston ram. The piston ram moves toward the jaws and pushes on a roller mechanism. The rollers spread the jaws and make a crimp. To retract the jaws the rear section of the rocker control is activated. This pushes on the release button and opens a valve within the pump body and permits fluid back to the reservoir. The spring in front of the ram section pushes the ram back to its rest position. Of course, this is only one example. Features of the invention could be provided in other types of configurations and methods of use.

Figure 20:
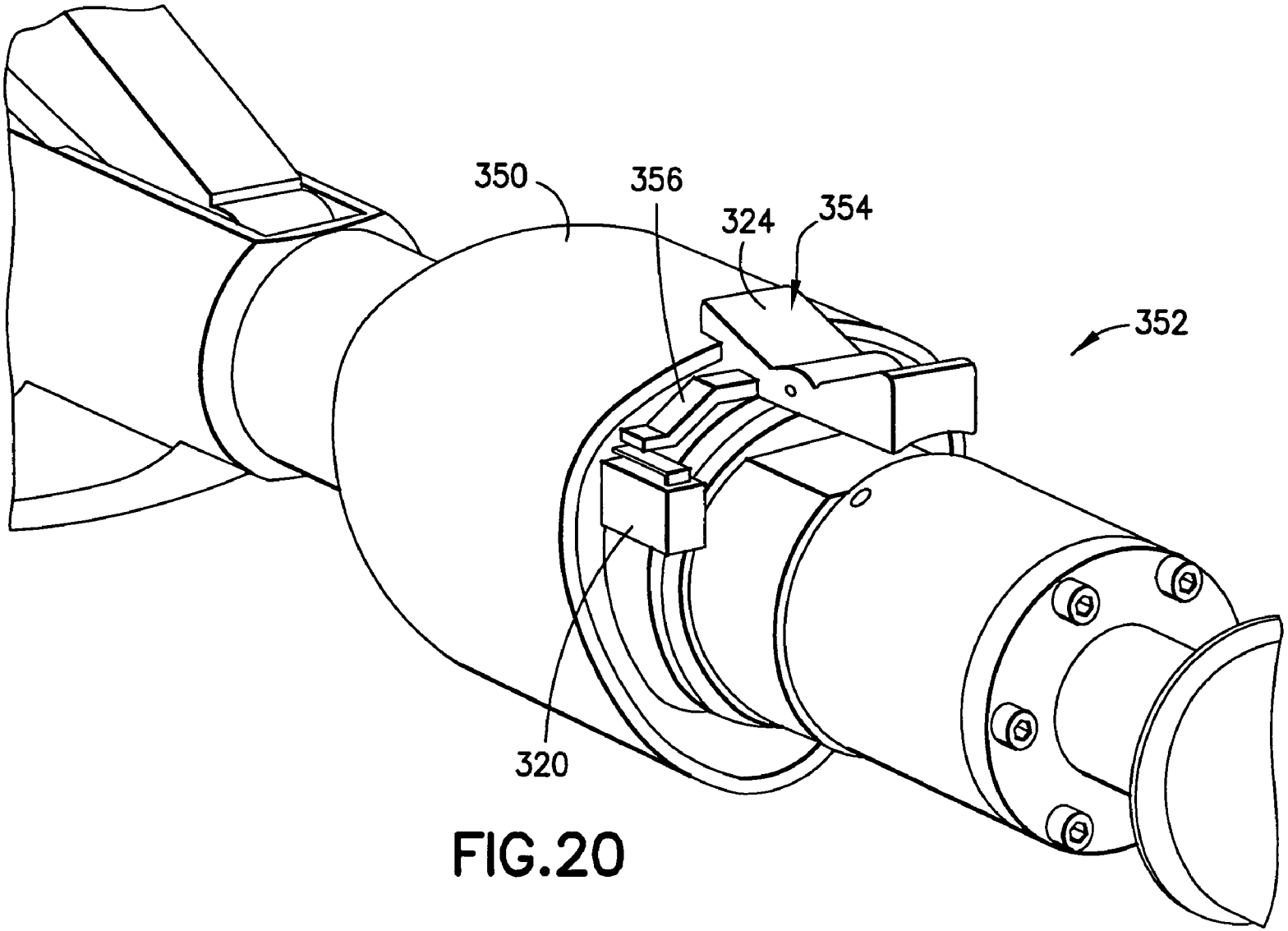
FIG. 20 is a partial perspective view with a cut away section of an embodiment of the user control shown in FIG. 18.
Figure 21:
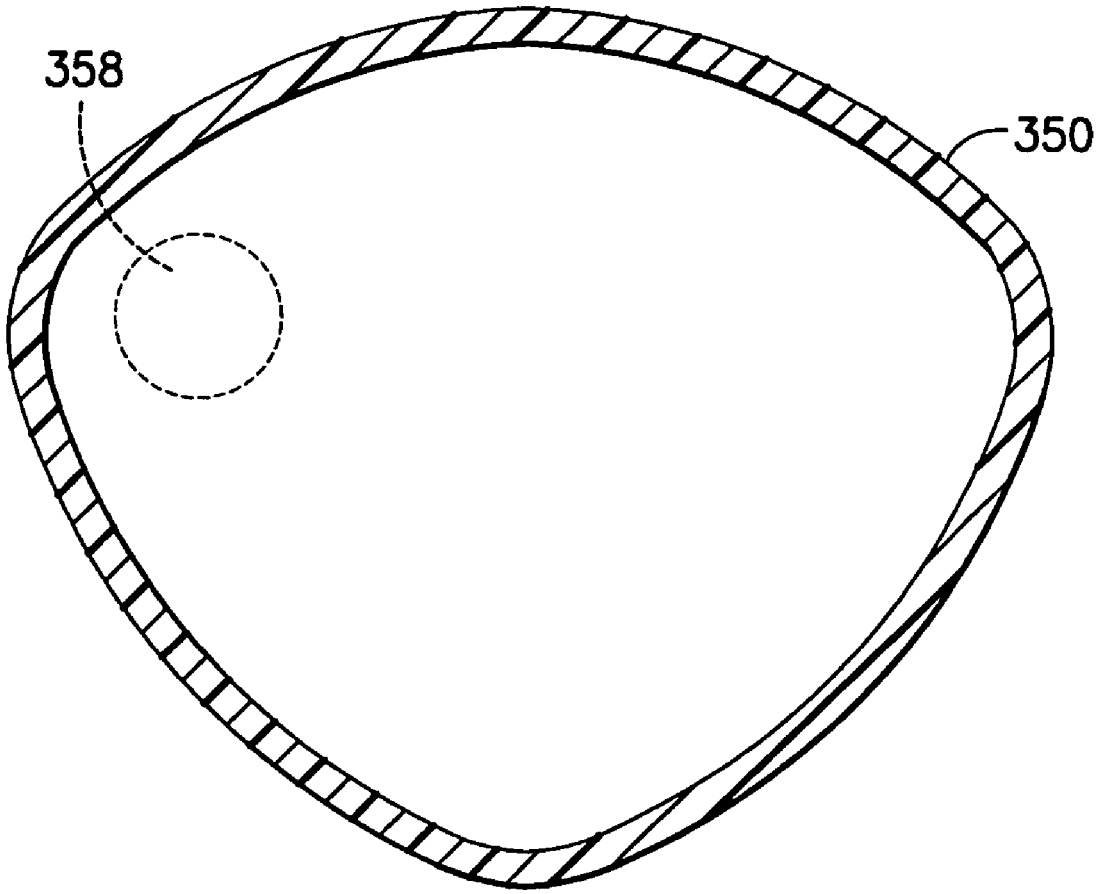
FIG. 21 is a cross sectional view of the outer housing of the tool shown in FIGS. 18-20.

Referring also to FIG. 20, there is shown a partial perspective view of an alternate embodiment of the tool shown in FIG. 18 with a cut away view of the outer housing 350. The tool 352 has a rocker member 354 with an integrally formed activation arm 356. The arm 356 extends from a lateral side of the front section 324. The distal end of the arm 356 is located at the momentary activation switch 320 which is located at the lateral side of the pump. The outer housing 350 has a slot for the top side of the rocker member 354 to extend through. The arm 356 and the switch 320 are housed inside the outer housing 350. Referring also to FIG. 21, the outer housing 350 has a general cross sectional triangular or tri-lobe shape. The tri-lobe shape allows accommodation of the switch 320 in area 358, but still provides a shape suitable for a user to grasp the outer housing 350 with one hand as a handle to hold the tool while depressing the rocker member 354 a thumb of with the same hand.

Figure 22:
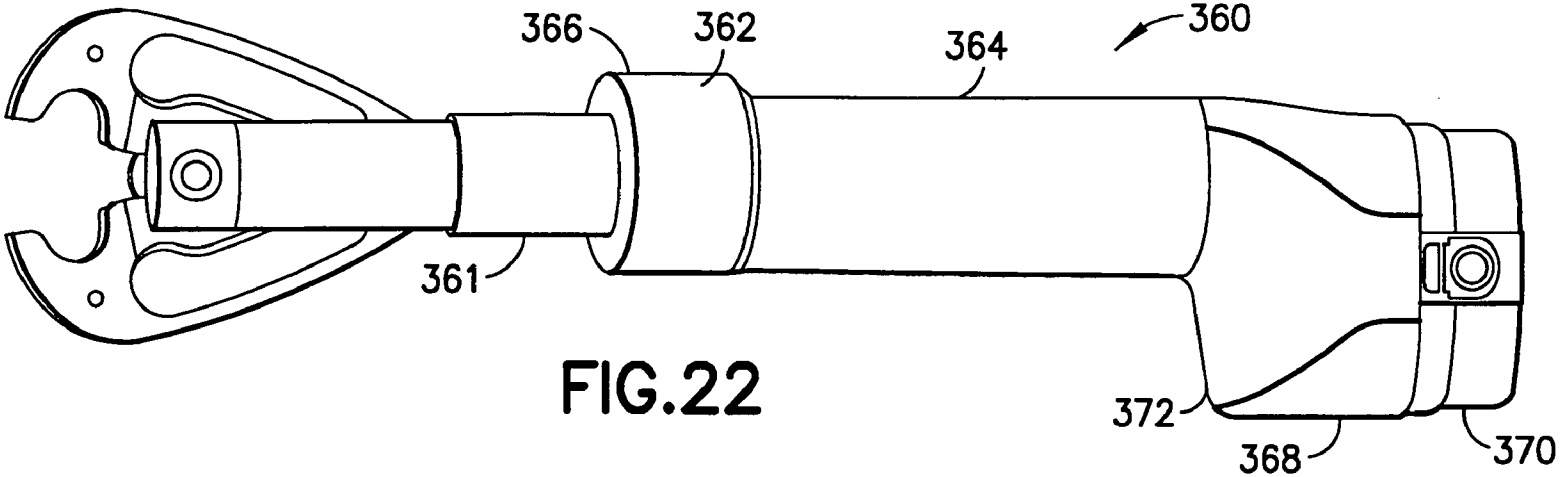
FIG. 22 is a side perspective view of one embodiment of the tool shown in FIG. 18.
Figure 23:
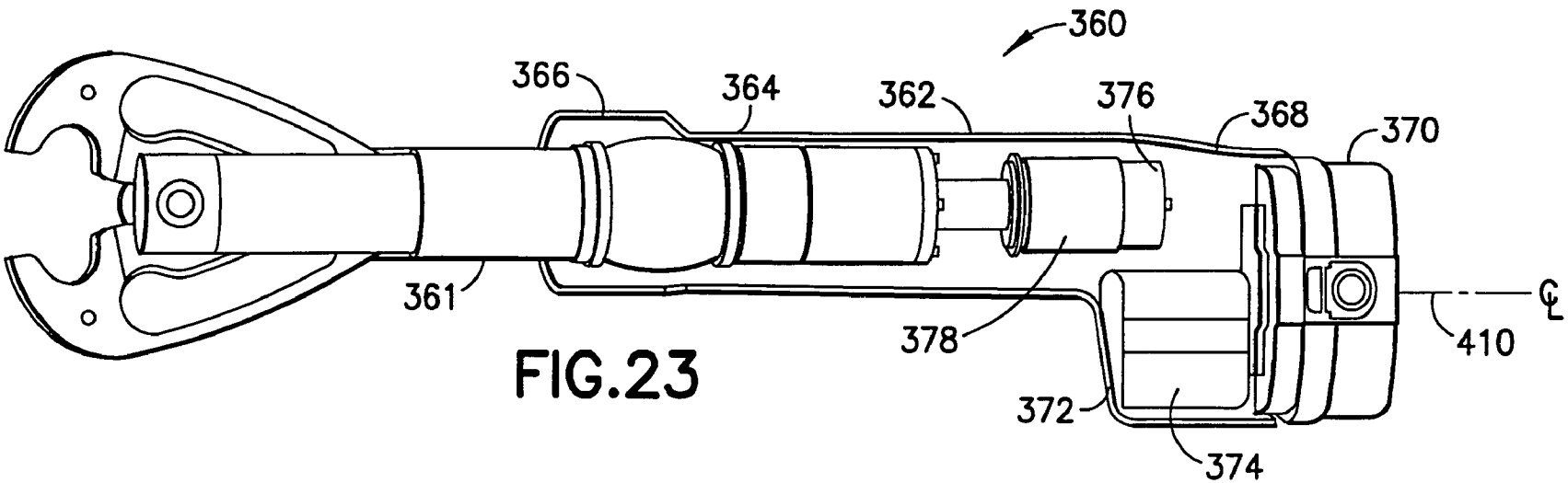
FIG. 23 is a side perspective view as in FIG. 22 with a cut-away section of the outer housing.

Referring now to FIGS. 22-27, there are shown side views and side views with cut away sections of three alternate embodiment configurations. FIGS. 22-23 shown a configuration of a tool 360 with an outer housing 362 having a general rod shaped handle section 364, which can be at least partially cross-sectionally tri-lobe shaped for example. An in-line subassembly 361 is provided inside the outer housing 362 comprising the front jaw assembly, the frame, the pump, the motor, the transmission and the reservoir. A front end 366 of the housing 362 is slightly enlarged to help prevent a user's hand from sliding forward off of the handle section 364. The rear end 368 of the outer housing 362 is adapted to removably attach the battery 370. A lower extension 372 of the rear end 368 accommodates a portion 374 of the battery 370. The lower extension 372 also helps to prevent a user's hand from sliding rearward off of the handle section 364. In this design the front of the battery 370 at portion 374 extends past the rear end 376 of the motor 378. The centerline 410 of the battery is offset from the centerline of the subassembly 361.

Figure 24:
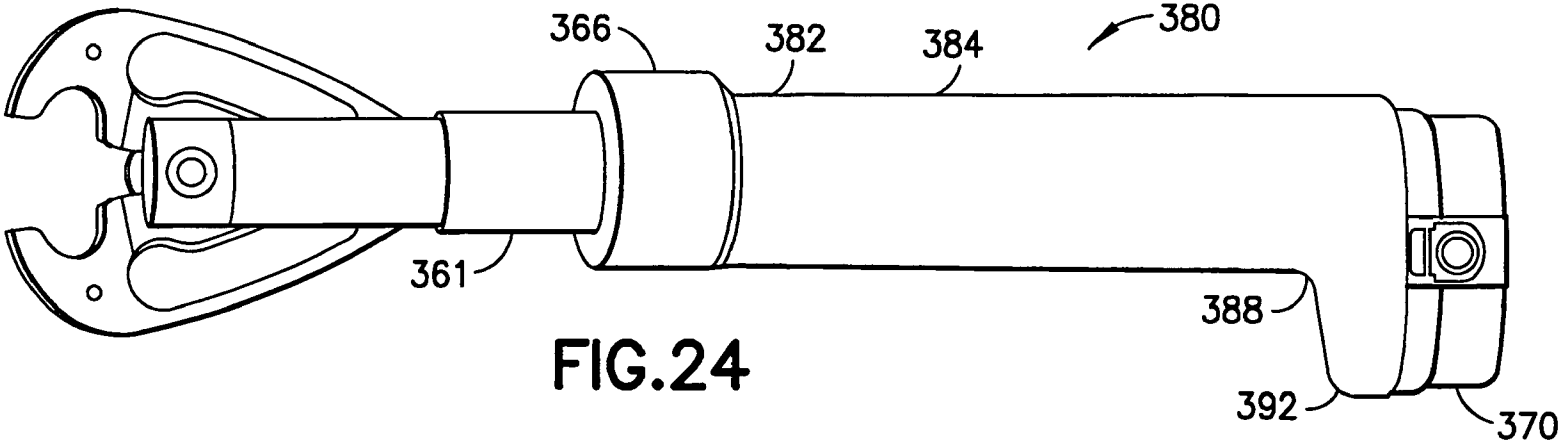
FIG. 24 is a side perspective view of one embodiment of the tool shown in FIG. 18.
Figure 25:
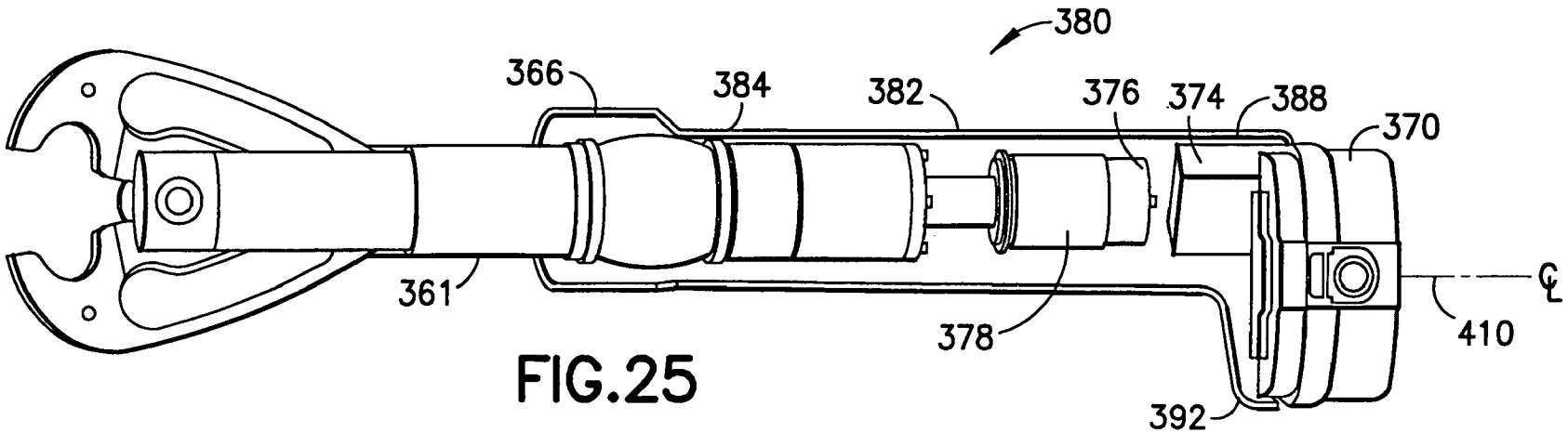
FIG. 25 is a side perspective view as in FIG. 24 with a cut-away section of the outer housing.

FIGS. 24-25 show a tool 380 with the same in-line subassembly 361, but a different outer housing 382. The outer housing 382 is longer in length than the outer housing 362. The outer housing 382 comprises a front end 366 of the housing 382 with a slightly enlarged shape to help prevent a user's hand from sliding forward off of the handle section 384. The rear end 388 of the outer housing 382 is adapted to removably attach the battery 370. A lower extension 392 of the rear end helps to prevent a user's hand from sliding rearward off of the handle section 384. The battery 370 is attached flipped relative to the position shown in FIG. 23. The portion 374 of the battery is located in-line with the subassembly 361. In this design the front of the battery 370 at portion 374 is located behind the rear end 376 of the motor 378. The centerline 410 of the battery is offset from the centerline of the subassembly 361.

Figure 26:
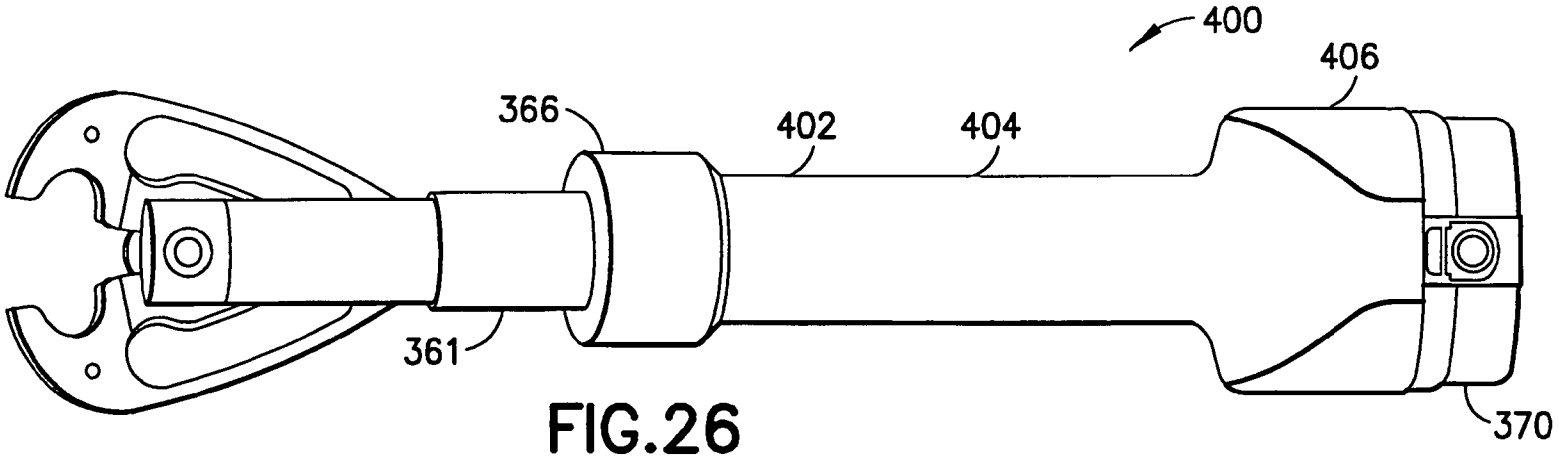
FIG. 26 is a side perspective view of one embodiment of the tool shown in FIG. 18.
Figure 27:
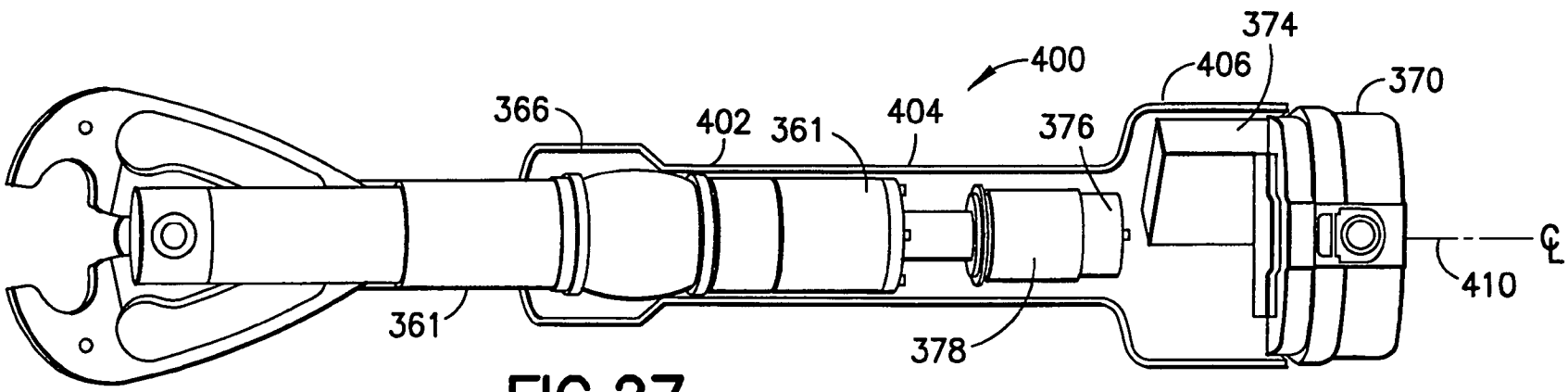
FIG. 27 is a side perspective view as in FIG. 26 with a cut-away section of the outer housing.

FIGS. 26-27 show a tool 400 with the same in-line subassembly 361, but a different outer housing 402. The outer housing 402 is longer in length than the outer housing 362. The outer housing 402 comprises a front end 366 with a slightly enlarged shape to help prevent a user's hand from sliding forward off of the handle section 404. The rear end 406 of the outer housing 402 is adapted to removably attach the battery 370. An enlarged area of the rear end, compared to the handle section 404, helps to prevent a user's hand from sliding rearward off of the handle section 404. The battery 370 is attached flipped relative to the position shown in FIG. 23. The portion 374 of the battery is located out of line with the subassembly 361, but the battery central axis 410 is located in-line with the central axis of the subassembly 361. In this design the front of the battery 370 at portion 374 is located behind the rear end 376 of the motor 378.

These are only some examples of ergonomic designs. The tools 360, 380, 400 preferably have a rocker member as shown in FIGS. 18 and 20, but any suitable user actuatable control could be provided. Preferably, the cross sectional shape of the handle sections are tri-lobe shaped. However, any suitable cross sectional shape(s) could be provide.

The embodiments shown in the drawings are merely intended to be exemplary; not limiting. In alternate embodiments, features described in the different embodiments in the figures could be combined into other embodiments (not shown). For example, the rocker switching system described with reference to FIGS. 18-20 could be used in any one of the embodiments shown in FIGS. 1-17 and 21-27.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hand-held, battery-powered, hydraulically-actuated tool comprising:

a frame forming a tool longitudinal axis;

a battery offset from the tool longitudinal axis; and located along the tool longitudinal axis:

a motor connected to the battery;

a hydraulic fluid pump connected to the motor;

a ram movably connected to the frame and adapted to be moved relative to the frame by hydraulic fluid pumped by the hydraulic fluid pump; and a working head adapted to be actuated by the ram, wherein the tool comprises a main section situated in an in-line configuration along the tool longitudinal axis, wherein a center longitudinal axis of the battery is offset from the tool longitudinal axis, and a recessed area located about on a bottom side of the main section, wherein the recessed area is of a size and shape to receive a portion of a user's forearm therein.

2. The hand-held, battery-powered, hydraulically-actuated tool of claim 1, further comprising a transmission assembly connecting the motor and the hydraulic fluid pump.

3. The hand-held, battery-powered, hydraulically-actuated tool of claim 1, further comprising: a handle movably connected to the main section by a movable handle connection, wherein the handle has a handle longitudinal axis, wherein the movable handle connection enables the handle to achieve at least two states: a first extended state wherein the handle longitudinal axis is at an angle to the tool longitudinal axis and a second collapsed state in which the handle longitudinal axis is about parallel to the tool longitudinal axis.

4. The hand-held, battery-powered, hydraulically-actuated tool of claim 3, further comprising a recess located on the main section, wherein the recess is of a size and shape to substantially enclose the handle when the handle achieves the second collapsed state.

5. The hand-held, battery-powered, hydraulically-actuated tool of claim 3, further comprising a hand grasp area located on the main section.

6. A hand-held, battery-powered, hydraulically-actuated tool comprising:

a frame;

a motor connected to the frame;

a hydraulic fluid reservoir connected to the frame;

a hydraulic fluid pump connected to the hydraulic fluid reservoir and the motor;

a ram adapted to be moved by hydraulic fluid pumped by the hydraulic fluid pump; and a working head adapted to be actuated by the ram, wherein the tool comprises a first section and a second section, wherein the first section comprises the working head and the ram, wherein the second section comprises a battery, wherein the first section has a first center longitudinal axis, wherein the second section has a second center longitudinal axis, wherein the first section is movably connected to the second section by a movable connection, wherein the movable connection enables the tool to achieve at least two states comprising a first state and a second state, wherein when in the first state the first center longitudinal axis is substantially parallel to the second center longitudinal axis, wherein when in the second state the first center longitudinal axis is at an angle relative to the second center longitudinal axis.

7. The hand-held, battery-powered, hydraulically-actuated tool of claim 6, further comprising a working head frame and a conduit connection between the first section and the second section, wherein the ram is movably connected to the working head frame and is adapted to be moved relative to the working head frame, wherein the conduit connection enables hydraulic fluid to traverse the movable connection, wherein the second section comprises the frame, the hydraulic fluid pump, the hydraulic fluid reservoir, and the motor.

8. The hand-held, battery-powered, hydraulically-actuated tool of claim 7, wherein the movable connection comprises a ball swivel.

9. The hand-held, battery-powered, hydraulically-actuated tool of claim 7, wherein the movable connection comprises a jointed link snakehead connection comprising a plurality of links connected to each other in series, wherein each link is pivotally connected to adjacent links.

10. The hand-held, battery-powered, hydraulically-actuated tool of claim 6, wherein the second section comprises a handle and at least one actuation trigger, wherein the handle comprises a trigger face along which the at least one actuation trigger is located on or substantially near, wherein the tool is in an in-line configuration when in the first state, wherein the tool is in a pistol configuration when in the second state.

11. The hand-held, battery-powered, hydraulically-actuated tool of claim 10, wherein the movable connection comprises a pivotal connection about which the second section may pivot relative to the first section, wherein the trigger face of the handle faces about downwards when the tool is in the first state.

12. The hand-held, battery-powered, hydraulically-actuated tool of claim 10, wherein the movable connection comprises a rotative connection about which the second section may rotate relative to the first section, wherein the trigger face of the handle faces about upwards when the tool is in the first state.

13. The hand-held, battery-powered, hydraulically-actuated tool of claim 10, further comprising an additional rotative connection that enables the working head to rotate about the first center longitudinal axis relative to the first section.

14. The hand-held, battery-powered, hydraulically-actuated tool of claim 6, wherein the first section further comprises the motor, the frame, the hydraulic fluid reservoir, and the hydraulic fluid pump, wherein the second section comprises a swivel handle, wherein the swivel handle is adapted to receive the battery.

15. The hand-held, battery-powered, hydraulically-actuated tool of claim 14, wherein the first section is adapted to receive the battery.

16. A hand-held, battery-powered, hydraulically-actuated tool comprising:

a frame;

a motor connected to the frame;

a hydraulic fluid reservoir connected to the frame;

a hydraulic fluid pump connected to the hydraulic fluid reservoir and the motor;

a ram movably connected to the frame and adapted to be moved relative to the frame by hydraulic fluid pumped by the hydraulic fluid pump;

a working head adapted to be actuated by the ram;

a battery connected to the motor; and a tool housing comprising a first section and a second section, wherein the first section at least partially surrounds the ram, the hydraulic fluid pump, the motor, and the frame, wherein the second section at least partially houses the battery, wherein the first section is movably connected to the second section by a movable connection, wherein the first section has a first center longitudinal axis and the second section has a second center longitudinal axis, wherein the movable connection enables the tool to achieve at least two states comprising a first in-line state wherein the first center longitudinal axis is substantially parallel to the second center longitudinal axis and a second angled state wherein the first center longitudinal axis is angled relative to the second center longitudinal axis.

17. A hand-held, hydraulically-actuated tool comprising:

a first section comprising a working head and a ram, wherein the first section comprises a first end and a second end, wherein the working head is located at the first end of the first section; and a second section connected to the first section by a first stationary connection, wherein the second section comprises at least one of a motor, a hydraulic fluid reservoir, and a hydraulic fluid pump, wherein the second section comprises a first end and a second end, wherein the first end of the second section is connected by the first stationary connection to the second end of the first section, wherein the first section has a first center longitudinal axis and the second section has a second center longitudinal axis, wherein the first center longitudinal axis is at an angle relative to the second center longitudinal axis.

18. The hand-held, battery-powered, hydraulically-actuated tool of claim 17, further comprising a third section connected to the second section by a second stationary connection, wherein the third section has a third center longitudinal axis, wherein the third center longitudinal axis is at an angle relative to the second center longitudinal axis, wherein the third section comprises a first end and a second end, wherein the first end of the third section is connected to the second end of the second section by the second stationary connection.

19. The hand-held, battery-powered, hydraulically-actuated tool of claim 18, wherein the third center longitudinal axis is about parallel to the first center longitudinal axis.

20. A hand-held, hydraulically-actuated tool comprising:

a first section comprising a working head and a ram, wherein the first section comprises a first end and a second end, wherein the working head is located at the first end of the first section;

a second section connected to the first section by a first stationary connection, wherein the second section comprises a first end and a second end, wherein the first end of the second section is connected by the first stationary connection to the second end of the first section; and a third section connected to the second section by a second stationary connection, wherein the third section comprises a first end and a second end, wherein the first end of the third section is connected by the second stationary connection to the second end of the second section, wherein at least one of the second section and the third section comprises at least one of a motor, a hydraulic fluid reservoir, and a hydraulic fluid pump, wherein the first section has a first center longitudinal axis, wherein the second section has a second center longitudinal axis, wherein the third section has a third center longitudinal axis, wherein the first center longitudinal axis is at an angle relative to the second center longitudinal axis, wherein the third center longitudinal axis is at an angle relative to the second center longitudinal axis.

21. The hand-held, battery-powered, hydraulically-actuated tool of claim 20, wherein the third center longitudinal axis is about parallel to the first center longitudinal axis.

22. A hand-held, hydraulically-actuated tool comprising:

a hydraulic pump;

a motor operably connected to the hydraulic pump;

a battery; and a user control operably connecting the battery to the motor, wherein the user control comprises a pivotable rocker member, wherein the rocker member has a first end section adapted to be moved to actuate an electrical switch and a second end section adapted to be moved to directly contact and move a hydraulic release valve.

23. A hand-held, battery-powered, hydraulically-actuated tool comprising:

a generally in-line subassembly comprising a motor, a pump and a jaw assembly;

an outer housing connected over a portion of the subassembly, wherein the outer housing comprises a portion located over the portion of the subassembly which has cross sectional tri-lobe shape; and a battery connected to a rear end of the outer housing.

24. A tool as in claim 23 wherein the battery has a centerline aligned with a centerline of the subassembly.

25. A tool as in claim 23 wherein the battery has a centerline which is not aligned with a centerline of the subassembly.

26. A tool as in claim 25 wherein the battery has a front portion located forward of a rear portion of the motor.

27. A tool as in claim 23 wherein the tri-lobe shape forms an open area inside one of the lobes, and wherein an electrical control switch is located the open area.

28. A tool as in claim 23 further comprising a rocker switch at a top side of the tri-lobe shape located between two of the lobes of the tri-lobe shape.

29. A hand-held, battery-powered, hydraulically-actuated tool comprising:

a frame;

a motor connected to the frame;

a hydraulic fluid reservoir connected to the frame;

a hydraulic fluid pump connected to the hydraulic fluid reservoir and the motor;

a ram adapted to be moved by hydraulic fluid pumped by the hydraulic fluid pump; and a working head adapted to be actuated by the ram, wherein the tool comprises a first section and a second section, wherein the first section comprises the working head and the ram, wherein the second section comprises a handle and a battery, wherein the first section has a first center longitudinal axis, wherein the second section has a second center longitudinal axis, wherein the first section is movably connected to the second section by a movable connection, wherein the movable connection enables the tool to achieve at least two configurations comprising a first configuration and a second configuration, wherein when the tool is in the first configuration and the second configurations the first center longitudinal axis is at respective first and second different positions relative to the second center longitudinal axis.

* * * * *